US010310433B2

(12) United States Patent
Uekawa et al.

(10) Patent No.: US 10,310,433 B2
(45) Date of Patent: Jun. 4, 2019

(54) IMAGE FORMING APPARATUS THAT CONTROLS A TEMPERATURE OF AT LEAST ONE OF A ROTATING MEMBER BASED ON A WEARING AMOUNT OF THE ROTATING MEMBER AND A PRESSING MEMBER BASED ON A HARDNESS CHANGE AMOUNT OF THE PRESSING MEMBER

(71) Applicant: CANON KABUSHIKI KAISHA, Tokyo (JP)

(72) Inventors: Eiji Uekawa, Susono (JP); Takayasu Yuminamochi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/907,591

(22) Filed: Feb. 28, 2018

(65) Prior Publication Data

US 2018/0246456 A1 Aug. 30, 2018

(30) Foreign Application Priority Data

Feb. 28, 2017 (JP) ..... 2017-037191
Jan. 30, 2018 (JP) ..... 2018-014102

(51) Int. Cl.
*G03G 15/00* (2006.01)
*G03G 15/20* (2006.01)

(52) U.S. Cl.
CPC ..... *G03G 15/553* (2013.01); *G03G 15/2039* (2013.01); *G03G 2221/1663* (2013.01)

(58) Field of Classification Search
CPC ..... G03G 15/553; G03G 15/2039; G03G 15/2078; G03G 221/1663; G03G 2221/1663
See application file for complete search history.

(56) References Cited

U.S. PATENT DOCUMENTS 5,592,277 A * 1/1997 Kusaka ..... G03G 15/2064 399/328
7,251,447 B2 1/2007 Kanamori et al.
(Continued)

FOREIGN PATENT DOCUMENTS

JP H04-204980 A 7/1992
JP 2002-148988 A 5/2002
(Continued)

*Primary Examiner* — Sandra Brase
(74) *Attorney, Agent, or Firm* — Venable LLP

(57) ABSTRACT

An image forming apparatus includes a fixing unit having a rotating member with a surface layer, a pressing member that forms a fixing nip portion to sandwich and to transport a recording material with the rotating member, and a heater that heats the rotating member. A rotating member temperature sensor detects a temperature of the rotating member, and a wearing amount acquisition portion acquires a wearing amount of the surface layer of the rotating member. The wearing amount acquisition portion acquires the wearing amount corresponding to the temperature detected by the rotating member temperature sensor, and acquires the wearing amount per recording material. The wearing amount per recording material is different depending on the temperature detected by the rotating member temperature sensor. In addition, a control temperature setting portion sets a control temperature of the heater according to the wearing amount.

24 Claims, 20 Drawing Sheets

(56) References Cited

U.S. PATENT DOCUMENTS

| | | | |
|---|---|---|---|
| 7,203,438 | B2 | 4/2007 | Omata et al. |
| 7,215,899 | B2 | 5/2007 | Kimizuka et al. |
| 7,518,089 | B2 | 4/2009 | Hashiguchi et al. |
| 8,606,164 | B2 | 12/2013 | Uekawa et al. |
| 9,002,249 | B2 | 4/2015 | Uekawa et al. |
| 9,280,108 | B2 | 3/2016 | Sato et al. |
| 9,442,443 | B2 | 9/2016 | Tsuchihashi et al. |
| 9,477,191 | B2 | 10/2016 | Sato et al. |

FOREIGN PATENT DOCUMENTS

| | | | |
|---|---|---|---|
| JP | 2014-178384 | * | 9/2014 |
| JP | 2016-130823 | * | 7/2016 |

* cited by examiner

RELATIONSHIP BETWEEN THICKNESS OF SURFACE LAYER OF FILM AND CONTROL TEMPERATURE ON REAR SIDE OF HEATER TO MAINTAIN FILM AT 180°C DURING PAPER FEEDING AT 60 ppm RELATIONSHIP BETWEEN TEMPERATURE AND CHANGE IN HARDNESS OF PRESSING ROLLER, UNTIL 1000 HOURS SINCE EARLY STAGE RELATIONSHIP BETWEEN TEMPERATURE AND CHANGE IN HARDNESS OF PRESSING ROLLER, AFTER 1000 HOURS

USE TIME AND CHANGE IN HARDNESS OF PRESSING ROLLER

TEMPERATURE TRANSITION OF FIXING UNIT AT PAPER FEEDING (a) CONTINUOUS PAPER FEEDING

TEMPERATURE TRANSITION OF FIXING UNIT AT PAPER FEEDING (b) INTERMITTENT PAPER FEEDING

RELATIONSHIP BETWEEN THICKNESS OF SURFACE LAYER OF FILM AND CONTROL TEMPERATURE ON REAR SIDE OF HEATER TO MAINTAIN FILM AT 180°C DURING PAPER FEEDING AT 60 ppm

IMAGE FORMING APPARATUS THAT CONTROLS A TEMPERATURE OF AT LEAST ONE OF A ROTATING MEMBER BASED ON A WEARING AMOUNT OF THE ROTATING MEMBER AND A PRESSING MEMBER BASED ON A HARDNESS CHANGE AMOUNT OF THE PRESSING MEMBER

This application claims the benefit of Japanese Patent Application No. 2017-037191, filed Feb. 28, 2017, and Japanese Patent Application No. 2018-140102, filed on Jan. 30, 2018, which are hereby incorporated by reference herein in their entireties.

BACKGROUND OF THE INVENTION

Field of the Invention

The present invention relates to an image forming apparatus, such as a copier or a laser beam printer (LBP), that adopts an image forming process, such as an electrophotographic system and an electrostatic recording system, and that includes a heating and fixing unit that heats and fixes an unfixed toner image, formed and borne on a recording material, onto the recording material.

Description of the Related Art

As a heating and fixing unit (hereinafter called a fixing unit), a film-heating fixing unit excellent in starting up a heater from a sleeping state, as described in, for example, Japanese Patent Application Laid-open No. H04-204980 has been known. In the film-heating fixing unit, a heater serving as a heating source and a pressing roller form a fixing nip portion via a cylindrical fixing film. Since the fixing unit with this configuration easily realizes low heat capacity and a small diameter, the fixing unit can enter a fixable state with relatively less power.

In addition, Japanese Patent Application Laid-open No. 2002-148988 has proposed a configuration that further reduces energy supplied to a fixing unit, the configuration using a foam rubber layer made of a sponge material or a balloon material as the rubber layer of a pressing roller. By the adoption of such structures, a heat insulating effect in the thickness direction of the pressing roller is enhanced. Therefore, the amount of heat transferred from a heater to the pressing roller may be reduced, and the heat energy of the heater may be more efficiently used.

Meanwhile, there has also been proposed a configuration that further improves energy-saving by enhancing the heat conductivity of the respective constituents of a path through which heat energy from a heater is transferred to toner on a recording material. For example, when the film-heating fixing unit, described above, uses a material having greater heat conductivity in the base layer or the rubber layer of the fixing film, the effect of reducing the control temperature of the heater is obtained.

As the low heat capacity of the whole fixing unit and the high heat conductivity of members advance in the manner described above, the degradation of printing quality and reduction in durability due to the wearing of the surface layer of a fixing film and a change in the hardness of a pressing roller have become problems.

In order to shorten a thermal starting-up time of a fixing unit, it is necessary to improve its heat conductivity or to reduce its heat capacity. To this end, a heat transferred portion needs to be thinned. In a case in which a heat transferred portion is a portion that rubs and slides like a fixing film, however, heat transfer greatly changes depending on a wearing degree, which may result in a situation in which the fixing unit is not allowed to exert its original performance.

The surface layer of the fixing film uses tetrafluoroethylene perfluoroalkylvinylether copolymer (PFA) or polytetrafluoroethylene (PTFE) representing heat resisting resin excellent in mold releasability to prevent the adhesion of toner. The resin hardly transfers heat, however, and the thickness of the surface layer has a major influence on the performance of the fixing unit.

When the surface layer of the fixing film wears, heat from the heater easily transfers to toner or a recording material. As a result, a hot offset occurs, or the paper curls after its fixation processing. In addition, the paper may wrinkle depending on a type of the recording material.

In addition, when heat is excessively supplied, the recording material shrinks in the longitudinal direction of a fixing nip portion inside the fixing nip portion. Thus, drape-shaped waves occur in a portion of the recording material before the recording material enters the fixing nip portion. When the portion enters the fixing nip portion, a paper wrinkle may occur.

On the other hand, the rubber material of the pressing roller degrades and the hardness thereof reduces with repeated stress due to heating and rotation.

Problems such as a hot offset and the curling of the recording material occur not only when the surface layer of the fixing film is thinned, but also when the hardness of the pressing roller reduces. When the rigidity of the pressing roller reduces, the width of the fixing nip portion in a recoding-material transporting direction increases and, as a result, a time to heat the recording material increases. Thus, heat is excessively supplied with an increase in the amount of the heat supplied to toner or the paper. In order to deal with the problems, it is assumed to change fixing conditions according to the use situations of an apparatus. For example, a condition such as control temperature is changed based on the number of sheets set in advance.

An actual wearing degree is different, however, depending on use conditions. The wearing of the fixing film and the reduction in the hardness of the pressing roller may advance earlier than expected. In this case, the problems described also occur. On the other hand, when the wearing of the fixing film and the reduction in the hardness of the pressing roller do not advance as expected, problems due to the insufficient supply of heat occur. For example, paper jamming resulting from a fixing failure or the accumulation of toner in the fixing unit due to the fixing failure, or the like, occurs.

In addition, a difference in the wearing degree of the fixing film or a difference in the degree of the change in the hardness of the pressing roller depending on use conditions has an influence not only on a problem in printing quality, but also on a timing for issuing a life alert.

The life of the fixing unit is different depending on the wearing degree of the fixing film or the degree of reduction in the hardness of the pressing roller. According to a method in which the life alert of the fixing unit is issued using information, such as the number of total printed sheets, total driving time, and the number of total rotations, there is a likelihood that the fixing unit comes to the end of the life before the issuance of the alert or the life alert is issued to the fixing unit that has not come to the end of the life.

SUMMARY OF THE INVENTION

The present invention has an object of providing an image forming apparatus capable of preventing the occurrence of an image failure even when a difference in heat transfer occurs due to the wearing of the surface layer of a fixing member, such as a fixing film, or even when a change in the hardness of a pressing member occurs.

In addition, the present invention has an object of providing an image forming apparatus capable of appropriately issuing a life alert.

In order to achieve the above object, one aspect of the present invention provides an image forming apparatus that prints an image on a recording material, the image forming apparatus comprising a fixing unit that fixes an image formed on a recording material onto the recording material, the fixing unit having a rotating member with a surface layer, a pressing member that forms a fixing nip portion to sandwich and to transport the recording material with the rotating member, and a heater that heats the rotating member, a temperature sensor that detects a temperature of the rotating member, a wearing amount acquisition portion that acquires a wearing amount of the surface layer of the rotating member, the wearing amount acquisition portion acquiring the wearing amount corresponding to the temperature detected by the temperature sensor, and a control temperature setting portion that sets a control temperature of the heater according to the wearing amount.

In order to achieve the above object, another aspect of the present invention provides an image forming apparatus that prints an image on a recording material, the image forming apparatus comprising a fixing unit that fixes an image formed on a recording material onto the recording material, the fixing unit having a rotating member with a surface layer, a pressing member that forms a fixing nip portion to sandwich and to transport the recording material with the rotating member, and a heater that heats the rotating member, a temperature sensor that detects a temperature of the rotating member, a wearing amount acquisition portion that acquires a wearing amount of the surface layer of the rotating member, the wearing amount acquisition portion acquiring the wearing amount corresponding to the temperature detected by the temperature sensor, and a life calculation portion that calculates a life of the rotating member according to the wearing amount.

In order to achieve the above object, yet another aspect of the present invention provides an image forming apparatus that prints an image on a recording material, the image forming apparatus comprising a fixing unit that fixes an image formed on a recording material onto the recording material, the fixing unit having a rotating member, a pressing member that forms a fixing nip portion to sandwich and to transport the recording material with the rotating member, and a heater that heats the rotating member, a temperature sensor that detects temperature of the pressing member, a hardness change amount acquisition portion that acquires a hardness change amount of the pressing member, the hardness change amount acquisition portion acquiring the hardness change amount corresponding to the temperature detected by the temperature sensor, and a control temperature setting portion that sets a control temperature of the heater according to the hardness change amount.

In order to achieve the above object, still another aspect of the present invention provides an image forming apparatus that prints an image on a recording material, the image forming apparatus comprising a fixing unit that fixes an image formed on a recording material onto the recording material, the fixing unit having a rotating member, a pressing member that forms a fixing nip portion to sandwich and to transport the recording material with the rotating member, and a heater that heats the rotating member, a temperature sensor that detects a temperature of the pressing member, a hardness change amount acquisition portion that acquires a hardness change amount of the pressing member, the hardness change amount acquisition portion acquiring the hardness change amount corresponding to the temperature detected by the temperature sensor, and a life calculation portion that calculates a life of the pressing member according to the hardness change amount.

Further features of the present invention will become apparent from the following description of exemplary embodiments with reference to the attached drawings.

DESCRIPTION OF THE EMBODIMENTS

Hereafter, a description will be given, with reference to the drawings, of embodiments (examples) of the present invention. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

First Embodiment

Figure 1:
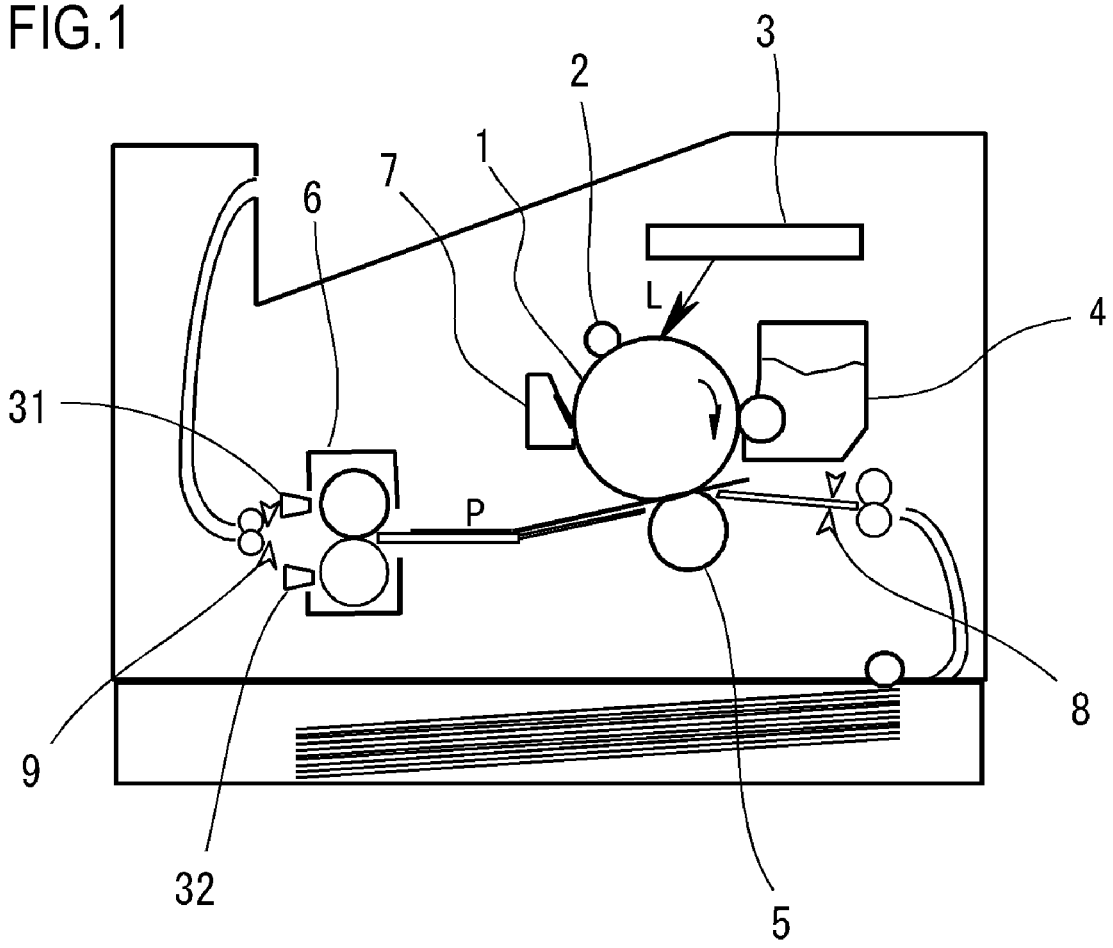
FIG. 1 is a schematic configuration view of an image forming apparatus according to a first embodiment of the present invention.

FIG. 1 is a schematic configuration view of an image forming apparatus according to a first embodiment of the present invention.

(1) Description of Image Forming Apparatus

In FIG. 1, reference symbol 1 shows a photosensitive drum in which a photosensitive material, such as an organic photoconductor (OPC), amorphous selenium, and amorphous silicon, is formed on an aluminum cylinder. The photosensitive drum 1 is rotationally driven in an arrow direction, and its surface is uniformly charged by a charging roller 2 serving as a charging device. Next, the photosensitive drum 1 is subjected to scanning exposure by a laser scanner 3, with laser light L controlled to be turned ON/OFF according to image information, and thus, an electrostatic latent image is formed on the photosensitive drum 1. The electrostatic latent image is developed and visualized by a developing apparatus 4.

The visualized toner image is transferred onto a recording material P by a voltage applied to a transfer roller 5 serving as a transfer device. Here, in order to align the image forming position of the toner image on the photosensitive drum 1 with the position of the recording material P, a top sensor 8 detects the tip end of the recording material P to adjust the transport timing of the recording material P. The recording material P transported at a prescribed timing is sandwiched and transported between the photosensitive drum 1 and the transfer roller 5. The recording material P, onto which the toner image has been transferred, is transported to a fixing unit 6, and thus, the toner image is fixed onto the recording material P as a permanent image.

Meanwhile, residual toner on the photosensitive drum 1 is removed from the surface of the photosensitive drum 1 by a cleaning apparatus 7. A paper discharging sensor 9 provided inside the fixing unit 6 is a sensor that detects paper jamming, or the like, caused by the recording material P between the top sensor 8 and the paper discharging sensor 9.

(2) Description of Fixing Unit 6

(2-1) Cross-Sectional Configuration of Fixing Unit 6

Next, a description will be given of the fixing unit 6.

Figure 2:
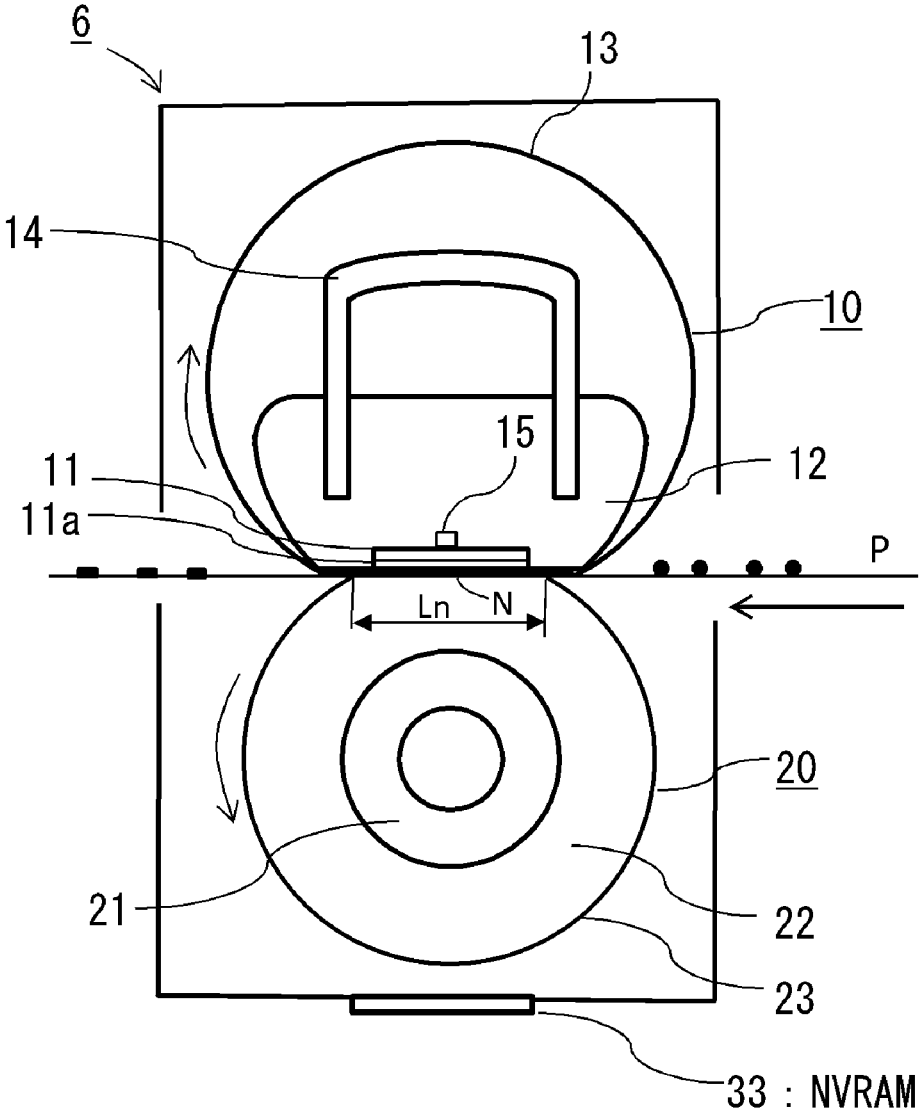
FIG. 2 is a schematic configuration view of a fixing unit shown in FIG. 1.

FIG. 2 is a schematic view showing the cross-sectional configuration of a central part in the longitudinal direction of the fixing unit 6 representing the first embodiment.

The fixing unit 6 includes a heating unit 10 provided with a heater 11 serving as a heating source and a cylindrical fixing film (fixing rotating member) 13, and a pressing roller 20 serving as a pressing member. A fixing nip portion N is formed by bringing the heater 11 and the pressing roller 20 into contact with each other at a prescribed pressing force via the fixing film 13. A toner image is fixed onto the recording material P when the recording material P that bears the unfixed toner image is heated while being fed to the fixing nip portion N.

The heating unit 10 is mainly constituted of the fixing film 13, the heater 11, a heat insulating holder 12 that holds the heater 11, a metal stay 14, or the like. The metal stay 14 receives a pressing force from a spring (not shown) and presses the heat insulating holder 12 toward the pressing roller 20.

The heater 11 is a plate-shaped member having low heat capacity, and contacts the inner surface of the fixing film 13. The heater 11 has an insulative ceramic substrate made of alumina, aluminum nitride, or the like. On the surface of the substrate, a heat generation resistance layer made of silver palladium (Ag/Pd), ruthenium oxide ($RuO_2$), tantalum nitride ($Ta_2N$), or the like, is formed by a printing technology, such as screen printing. As shown in FIG. 2, on the surface of the heater 11 that contacts the fixing film 13, a protection layer 11*a*, such as a glass layer, that protects the heat generation resistance layer is provided so as not to impair heat efficiency. The heat insulating holder 12 that holds the heater 11 is made of heat resisting resin, such as liquid crystal polymer, phenol resin, polyphenylene sulfide (PPS), and polyether ether ketone (PEEK), and also plays a role in guiding the rotation of the fixing film 13.

The base layer of the fixing film 13 is a heat resisting film having a total thickness of 200 μm or less. By reducing the thickness (reducing the heat capacity) of the base layer, it is possible to increase the temperature of the fixing film 13 to a temperature at which the fixing film 13 is capable of being fixed in a short period of time. The base layer of the fixing film 13 is made of heat resisting resin, such as polyimide, polyamide imide, and PEEK, or a pure metal or an alloy, such as steel use stainless (SUS), aluminum, nickel, copper, and zinc having heat resistance and high heat conductivity. On the other hand, in order to constitute the fixing unit 6 having a long life, it is necessary to make the base layer have substantial strength and excellent in durability. To this end, it is necessary for the base layer of the fixing film 13 to have a thickness of 20 μm or more. Accordingly, the base layer of the fixing film 13 optimally has a thickness of at least 20 μm and not more than 200 μm.

In addition, in order to prevent an offset and to assure the separability of the recording material, the surface layer of the fixing film 13 is coated with heat resisting resin excellent in mold releasability, such as fluorocarbon resin, such as polytetrafluoroethylene (PTFE), tetrafluoroethylene perfluoroalkylvinylether copolymer (PFA), tetrafluoroethylene hexafluoropropylene copolymer (FEP), ethylene tetrafluoroethylene copolymer (ETFE), polychlorotrifluoroethylene (CTFE), and polyvinylidene fluoride (PVDF), and silicon resin by mixture or singly.

Moreover, a silicon rubber layer having a thickness of about 100 μm to 300 μm may be formed between the surface layer and the base layer as an intermediate rubber layer. By forming the intermediate rubber layer, it is possible for the surface of the fixing film 13 to adapt to the unevenness of the surface of the recording material or the unevenness of a toner image and to provide excellent image quality.

The pressing roller 20 is an elastic roller having an elastic layer 22 on the outside of a metal cored bar 21 made of SUS, steel use machinability (SUM), and aluminum. In addition, the pressing roller 20 may have a surface layer 23 on the elastic layer 22, as shown in FIG. 2.

The elastic layer 22 is an elastic solid rubber layer made of a heat resisting rubber, such as a silicon rubber and a fluorine rubber, a sponge rubber layer in which silicon rubber is foamed to have a greater heat insulating effect, a foam rubber layer in which a hollow filler (such as micro balloons) is dispersed in a silicon rubber layer to make a burned cured object have a gas portion to enhance a heat insulating effect, or the like.

In addition, the surface layer 23 is made of PFA, PTFE, or the like.

Moreover, the pressing roller 20 receives a driving force to drive in an arrow direction shown in FIG. 2 via a driving gear (not shown) provided at the end of the cored bar 21. The driving force is transmitted from a motor (not shown) according to instructions from a central processing unit (CPU) 100 (not shown in FIG. 2) that serves as control means. As the pressing roller 20 is rotationally driven, the fixing film 13 is driven to rotate by the frictional force between the fixing film 13 and the pressing roller 20. Lubricant, such as fluorine-based or silicon-based heat resisting grease, is interposed between the fixing film 13 and the heater 11. As a result, the frictional resistance between the fixing film 13 and the heater 11 is kept low, whereby the fixing film 13 may be smoothly rotated.

Further, a thermistor 15 is provided on the rear surface of the ceramic substrate as a temperature sensor. According to a signal from the thermistor 15, the CPU 100 controls the duty ratio of power supplied to the heater 11 so that the heater 11 maintains control temperature. Thus, a temperature inside the fixing nip portion N may be maintained at a desired temperature. The temperature sensor is not limited to a thermistor, and may include various sensors.

The fixing unit 6 has a storage medium 33, such as a non-volatile random access memory (NVRAM), serving as storage means or a storage portion. The storage medium 33 communicates with the CPU 100 and stores the operating statuses of the fixing unit 6.

Note that, in the product specifications of the first embodiment, the image forming apparatus performs printing on A4-size paper in vertical feeding, in which the image forming apparatus is capable of printing 60 sheets per minute. Paper transporting speed inside the apparatus is 400 mm/second. The fixing film 13, the pressing roller 20, or the like, that contacts the recording material P also rotates at the same peripheral speed as the paper transporting speed. In addition, the fixing unit 6 is replaceable with respect to the image forming apparatus and is configured to be replaced when the image forming apparatus prints 150,000 (150 k) sheets.

Next, a description will be given of the specific examples of the respective constituents of the fixing unit 6.

The fixing film 13 has an outer diameter of 30 mm. The base layer of the fixing film 13 is made of polyimide (PI) and has a thickness of 60 μm, in which carbon fibers are dispersed to improve heat conduction. The fixing film 13 has a silicon rubber layer having a thickness of 250 μm on the base layer as an elastic layer. The surface layer is a PFA layer having a thickness of 20 μm and obtained by coating the silicon rubber layer with a tube made of PFA.

The pressing roller 20 has an outer diameter of 30 mm. The cored bar 21 is made of iron and has an outer diameter of 23 mm. The pressing roller 20 has a solid silicon rubber layer having a thickness of about 3.5 mm on the cored bar 21 as the elastic layer 22. In addition, the elastic layer 22 is coated with a PFA tube having a thickness of 50 μm as the surface layer 23.

The pressing roller 20 is so molded that its hardness as measured using an Asker C hardness meter on a surface (i.e., the surface 23) at 1 kg becomes 55°. At this time, the hardness of the silicon rubber layer is 17° under the same measurement condition.

In addition, the pressure applied between the pressing roller 20 and the fixing film 13 is 15 kgf.

(2-2) Description of Temperature Sensors that Detect Surface Temperature of Fixing Film 13 and Pressing Roller 20

Figure 3:
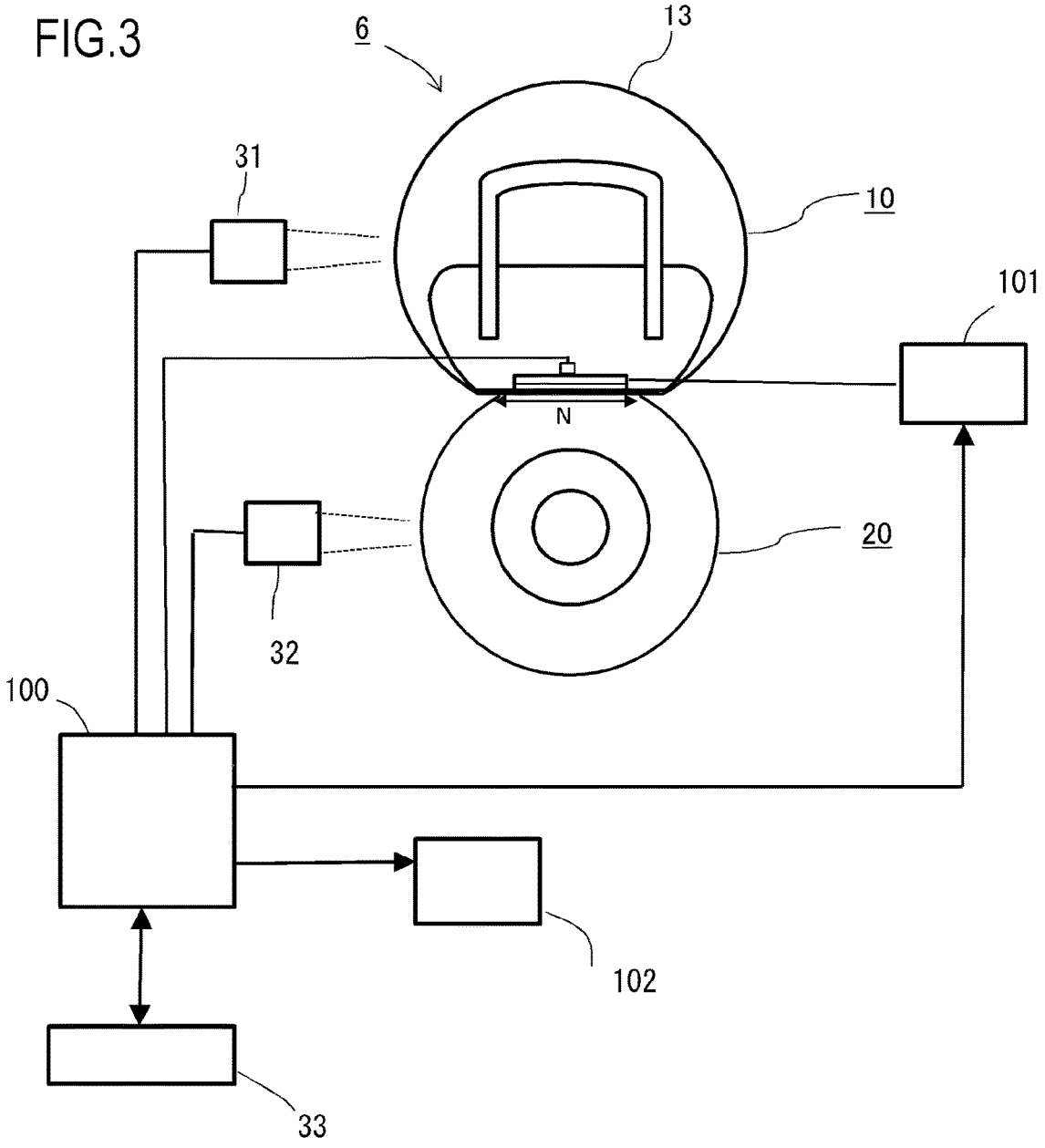
FIG. 3 is a schematic configuration view of the fixing unit shown in FIG. 1 and temperature sensors.

FIG. 3 is a schematic configuration view of temperature sensors that measure the surface temperature of the fixing film 13 and the surface temperature of the pressing roller 20 in the fixing unit 6.

Reference symbol 31 shows a non-contact temperature sensor that detects the surface temperature of the fixing film 13. In addition, reference symbol 32 shows a non-contact temperature sensor that detects the surface temperature of the pressing roller 20. As the temperature sensors 31 and 32, non-contact thermistors, such as thermopiles, are preferably used.

The temperature sensors 31 and 32 are installed in the image forming apparatus. When the fixing unit 6 is attached to or detached from the image forming apparatus, the temperature sensors 31 and 32 may be structured to retract so as not to interfere with the fixing unit 6. Alternatively, the temperature sensors 31 and 32 may be included in the attachable/detachable fixing unit 6.

The surface temperature of the fixing film 13 and the surface temperature of the pressing roller 20 measured by the temperature sensors 31 and 32, respectively, are temporarily stored in the storage medium 33, such as an NVRAM shown in FIG. 2, provided in the fixing unit 6 or the body of the image forming apparatus. The temperature information is loaded into the CPU 100 serving as control means to be reflected on controlling the temperature of the fixing unit 6. Alternatively, the measured temperature is directly transmitted to the CPU 100 in each case, and then is used for the management of the life of the fixing unit 6, or the like. A specific control method will be described below. Note that the CPU 100 outputs a temperature control signal and an alert signal to a temperature control circuit 101 and a display panel 102, respectively.

(3) Description of Temperature and Wearing Amount of Surface Layer of Fixing Film 13

The surface layer of the fixing film 13 wears as the paper is fed. This is because there is a slight difference in the peripheral speed between the paper material of the recording material P and the fixing film 13.

The fixing film 13 is driven to rotate with the rotation of the pressing roller 20. The pressing roller 20 transports the recording material P, and the fixing film 13 rotates due to the frictional force between the recording material P and the fixing film 13. Since the surface of the fixing film 13 is made of a material having a high mold releasability, the fixing film 13 has a low frictional coefficient. In addition, since the inner surface of the fixing film 13 slidingly contacts the heater 11 and the heat insulating holder 12, the peripheral speed of the fixing film 13 becomes slower than the transporting speed of the recording material P.

The recording material P contains minerals, such as calcium carbonate and kaolin, as fillers to make the paper white and opaque. The fillers shave the surface layer of the fixing film 13 as abrasives.

The speed at which the surface layer of the fixing film 13 wears depends on the surface temperature and the time during which the temperature is applied. Resin, such as PFA and PTFE used in the surface layer of the fixing film 13, softens with an increase in the temperature. Therefore, the fillers of the paper more deeply break into the fixing film 13 when the fixing film 13 and the recording material P are pressed at the fixing nip portion N. It appears that the wearing accelerates when a difference in the peripheral speed between the fixing film 13 and the recording material P occurs in this state.

Note that the hardness of the resin changes with heating time. The hardness of the resin changes according to elastic deformation due to outer stress and viscosity deformation due to the temperature described above, but the viscosity deformation depends on the heating time. Therefore, there is a likelihood that the resin hardens at the beginning of the heating and softens as the heating time elapses to some extent.

Figure 6:
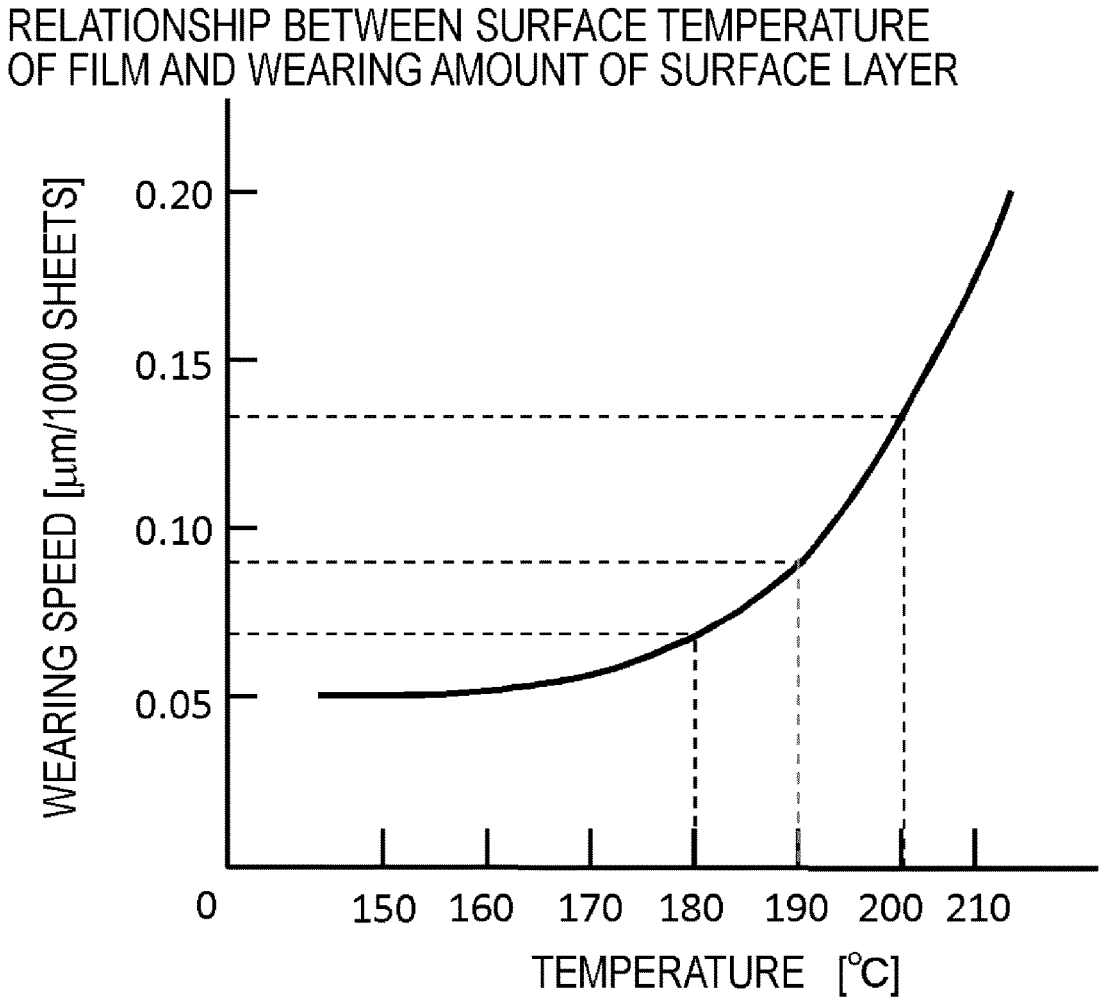
FIG. 6 is a graph showing the relationship between the surface temperature and the wearing amount of the fixing film.

FIG. 6 shows the relationship between the surface temperature and the wearing speed of the fixing film 13.

In FIG. 6, a horizontal axis shows the temperature of the fixing film 13, and a vertical axis shows the wearing speed of the surface layer of the fixing film 13, i.e., the wearing amount of the surface layer for every 1000 sheets.

The surface layer is not excessively shaved when the temperature is low, but the wearing amount increases when the temperature becomes high. The wearing amount for every 1000 sheets is 0.07 μm when the surface temperature is about 180° C., but is 0.13 μm when the surface temperature is 200° C. Note that the wearing amounts shown in FIG. 6 are those considering both the elastic deformation and the viscosity deformation.

In the first embodiment, the fixing film 13 starts wearing due to the viscosity deformation when the surface temperature of the fixing film 13 reaches 160° C. In a state in which the fixing unit 6 has been cooled at about room temperature, it takes about 4.8 seconds for the surface temperature of the fixing film 13 to reach 160° C. since the energization of the heater 11 starts. Therefore, the wearing amount is small before 4.8 seconds elapses, and the fixing film 13 almost constantly wears at 0.05 μm for every 1000 sheets.

In addition, the time until the viscosity deformation starts changes with the temperature of members. According to the configuration of the first embodiment, the viscosity deformation starts in about 6 seconds when the surface temperature of the fixing film 13 is 160° C. to 175° C., starts in about 3.5 seconds when the surface temperature is 175° C. to 200° C., and starts in about 1 second when the surface temperature is 200° C. or more.

The temperature of the heater 11 is controlled based on a signal from the thermistor 15 provided on the rear surface of the heater 11. In the first embodiment, power supplied to the heater is controlled so that a temperature detected by the thermistor 15 is maintained at the control temperature 200° C.

When 60 sheets are printed per minute at the control temperature 200° C. in a state in which the fixing film 13 is brand-new, the temperature of the fixing film becomes 180° C.

Figure 7:
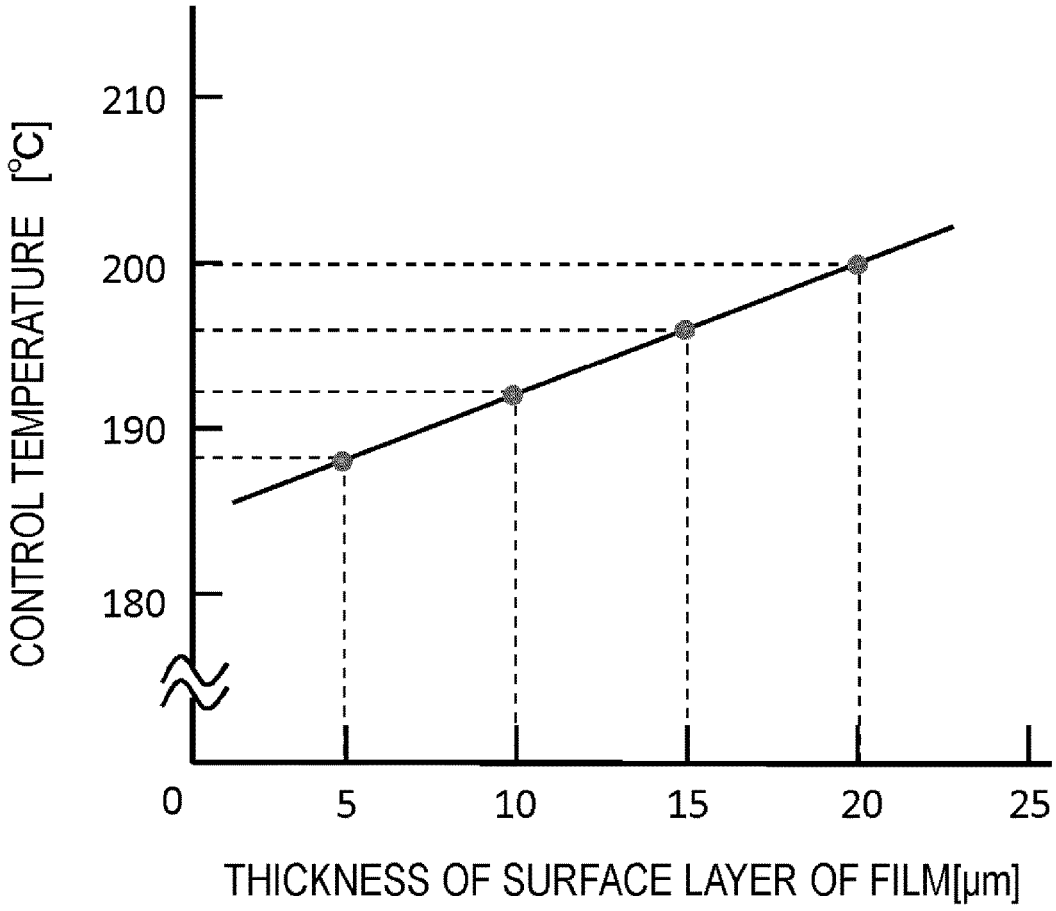
FIG. 7 is a graph showing the relationship between the thickness of the surface layer of the fixing film and a control temperature.

When the thickness of the surface layer of the fixing film 13 reduces, the surface temperature of the fixing film becomes high even if the control temperature remains the same. In order to prevent this problem, the control temperature is changed according to the thickness of the surface layer of the fixing film 13 in the first embodiment. FIG. 7 shows the relationship between the thickness of the surface layer and the control temperature.

In FIG. 7, a horizontal axis shows the thickness of the surface layer, and a vertical axis shows the control temperature at which the surface of the fixing film is maintained at 180° C. when 60 sheets are printed per minute. The control temperature is 200° C. when the thickness of the surface layer is 20 μm, but changes to 196° C. when the thickness is 15 μm, changes to 192° C. when the thickness is 10 μm, and changes to 188° C. when the thickness is 5 μm. As will be described later, the control temperature is used for a life notification timing, or the like.

(4) Description of Temperature and Hardness Reduction Amount of Pressing Roller 20

When the hardness of the pressing roller 20 is small (when the pressing roller 20 is soft), the time at which the recording material P passes through the fixing nip portion N becomes long and the amount of heat transferred to the recording material P and the toner becomes great. Therefore, the effect of melting the toner is enhanced.

On the other hand, when the hardness of the pressing roller 20 is great (when the pressing roller 20 is hard), an inexpensive and small motor that has a small torque to drive the fixing unit 6 and produces a small torque may be used.

Since the hardness of the pressing roller 20 is likely to gradually reduce as the pressing roller 20 is used, the hardness is set in consideration of the above circumstances. In the first embodiment, the hardness of the pressing roller 20 is set at 55°. Note that a motor, with specifications under which the pressing roller 20 may be driven so long as the lower limit of the hardness of the pressing roller 20 is above 50°, is used.

Figure 8:
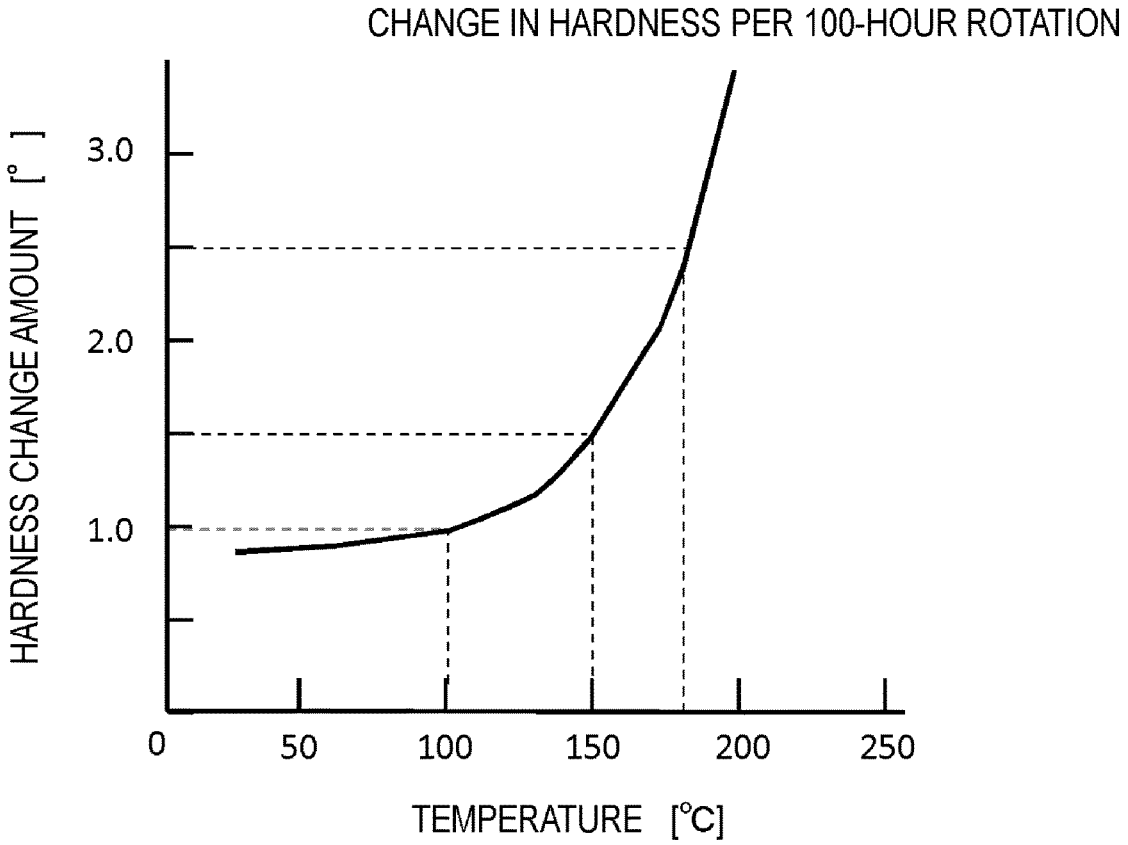
FIG. 8 is a graph showing the relationship between the surface temperature and the amount of a change in the hardness of a pressing roller.
Figure 9:
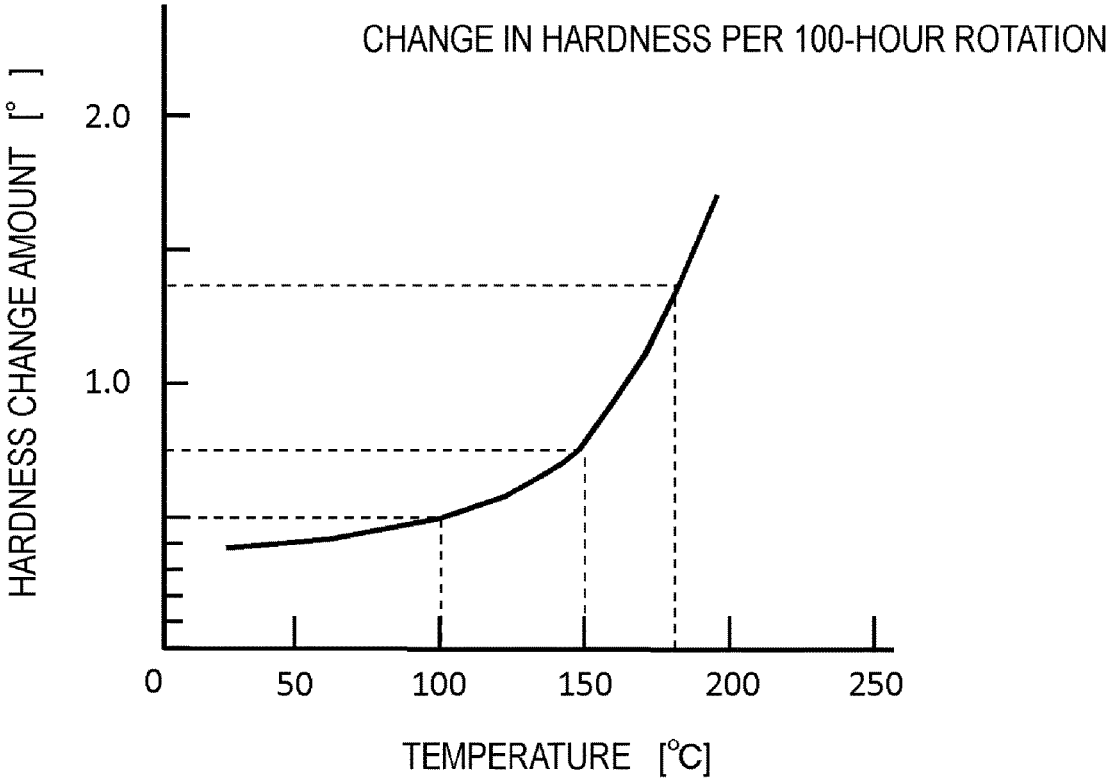
FIG. 9 is a graph showing the relationship between the surface temperature and the amount of the change in the hardness of the pressing roller.

FIG. 8 is a graph showing the surface temperature and the hardness reduction speed of the pressing roller 20. In FIG. 8, a horizontal axis shows the surface temperature of the pressing roller 20, and a vertical axis shows the hardness reduction speed for every 100-hour rotating time.

A hardness change amount for every 100-hour rotating time is about 1° when the temperature of the pressing roller 20 is about 100° C., and is 2.5° when the temperature is 180° C.

Table 1 shows the relationship between the hardness of the pressing roller 20, a width Ln of the fixing nip portion N, and the control temperature necessary for obtaining constant fixability in the first embodiment.

When the hardness of the pressing roller 20 reduces by 2°, the nip width increases by 0.5 mm. In order to obtain the constant fixability, it is necessary to reduce the control temperature by 3°.

TABLE 1

Relationship between Rigidity of Pressing roller, Nip Width, and Appropriate Control temperature

| Hardness of pressing roller | Nip width | Appropriate temperature change amount |
|---|---|---|
| 55° | 9.5 mm | Reference |
| 54° | 9.8 mm | −2° |
| 53° | 10.0 mm | −3° |
| 52° | 10.1 mm | −4° |

(5) Description of Paper Feeding Mode and Temperature of Fixing Film 13

A paper feeding sequence based on the fixing unit 6 is constituted of the following four steps.

Pre-rotation step: A pre-rotation step includes the preparation step of stabilizing the potential of the photosensitive drum 1 and the rotation of the laser scanner 3, the transporting step of forming an image on the photosensitive drum 1 and transporting the recording material P, onto which the image on the photosensitive drum 1 has been transferred, to the fixing unit 6, and a warming-up step of warming up the fixing film 13 and the pressing roller 20. The warming-up step overlaps with the preparation step and the transport step in terms of time.

Paper feeding step: A paper feeding step is the step of causing the recording material P, on which unfixed toner has been transferred, to pass through the fixing nip portion N to be fixed. In the paper feeding step, the recording material P is present in the fixing nip portion N.

Inter-paper step: An inter-paper step is the step of placing the interval between the preceding recording material P and the following recording material P when continuous paper feeding is performed. In the inter-paper step, the recording material P is not present in the fixing nip portion N during the continuous paper feeding.

Post-rotation step: A post-rotation step refers to a rotating time at which the recording material P is discharged to the outside of the apparatus.

A time required to perform each of the steps is set as follows: Pre-rotation step: 6 seconds, Paper feeding step: 0.74 seconds (A4 size: 297 mm), Inter-paper step: 0.25 seconds, and Post-rotation step: 1 second.

The temperature of the fixing film 13 and the pressing roller 20 changes according to paper feeding conditions. A description will be given, with reference to FIGS. 4 and 5, of a change in the temperature under the above conditions.

Figure 4:
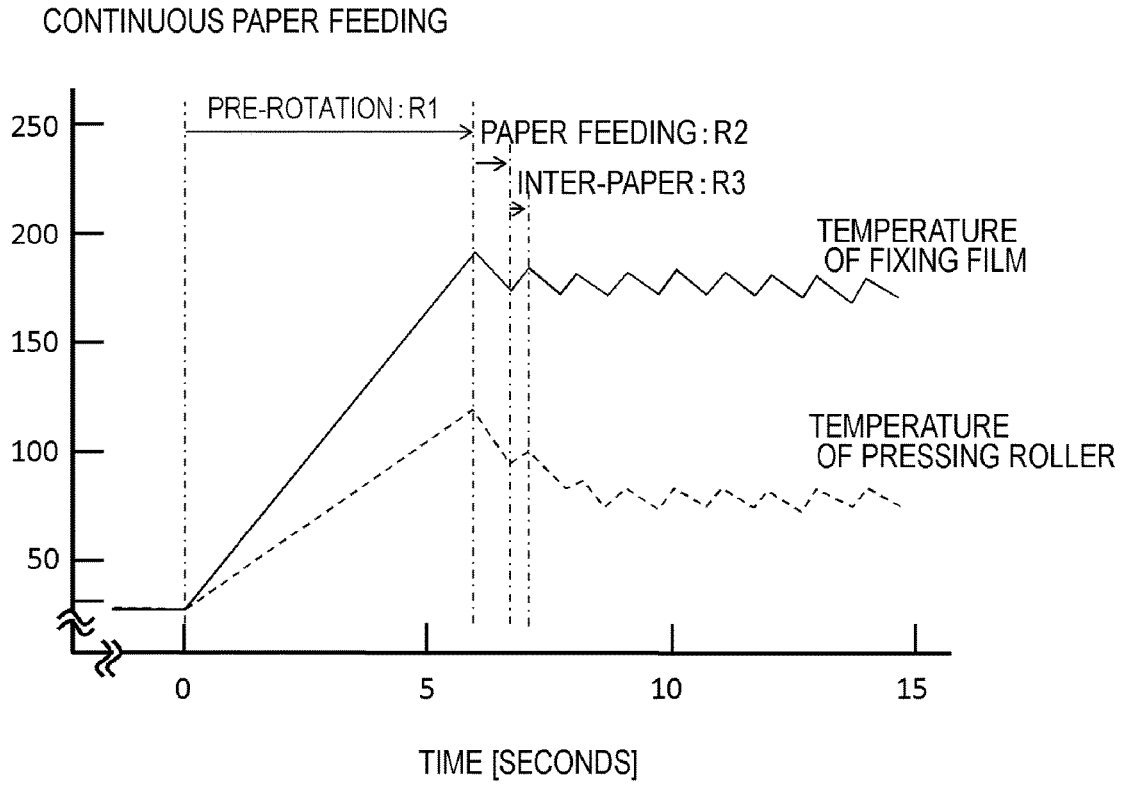
FIG. 4 is a graph for describing the temperature of members in the case of continuous paper feeding in the first embodiment.

FIG. 4 shows the temperature transitions of the fixing film 13 and the pressing roller 20 when printing is continuously performed. In FIG. 4, a horizontal axis shows time, and a vertical axis shows temperature. A solid line shows the surface temperature of the fixing film 13, and a broken line shows the surface temperature of the pressing roller 20. In the time axis, R1 shows the period of the pre-rotation step, R2 shows the period of the paper feeding step, and R3 shows the period of the inter-paper step.

When paper feeding is continuously performed, the paper feeding step and the inter-paper step are repeatedly performed until a specified number of sheets are printed after the pre-rotation step (the post-rotation step is not performed). At the paper feeding, the temperature of the fixing unit is controlled according to a temperature detected by the thermistor 15 provided on the rear surface of the heater 11. The control temperature of the heater 11 is 200° C.

In the period of the pre-rotation step R1, much power is input to the heater 11 so that temperature on the rear side of the heater 11 becomes a temperature necessary for performing fixation.

In the period of R1, image formation is performed with an adjusted timing so that the recording material P enters the fixing nip portion N at a point at which the temperature of the thermistor 15 has reached 200° C.

In the period R2 of the paper feeding step and the period R3 of the inter-paper step, the CPU 100 controls the energization of the heater 11 so that the temperature detected by the thermistor 15 becomes the constant temperature 200° C.

Since the heat of the fixing film 13 is taken away by the recording material P when the paper feeding is continuously performed, the surface temperature of the fixing film 13 becomes about 180° C.

The temperature of the pressing roller 20 also reduces with the paper feeding and is stabilized at about 80° C.

When printing is performed at the fastest throughput of the product, as described above, both the temperature of the fixing film 13 and the temperature of the pressing roller 20 transition to a lower side.

When 150,000 sheets equivalent to the life of the fixing unit 6 of the embodiment are printed under the conditions, the surface layer of the fixing film 13 is shaved by 12.6 μm.

Meanwhile, when 150,000 sheets are printed at a printing speed of 60 ppm, the pressing roller rotates for about 41 hours. A reduction in the hardness of the pressing roller 20 after the pressing roller rotates for 41 hours is, however, only 0.5° and causes no problem.

Figure 5:
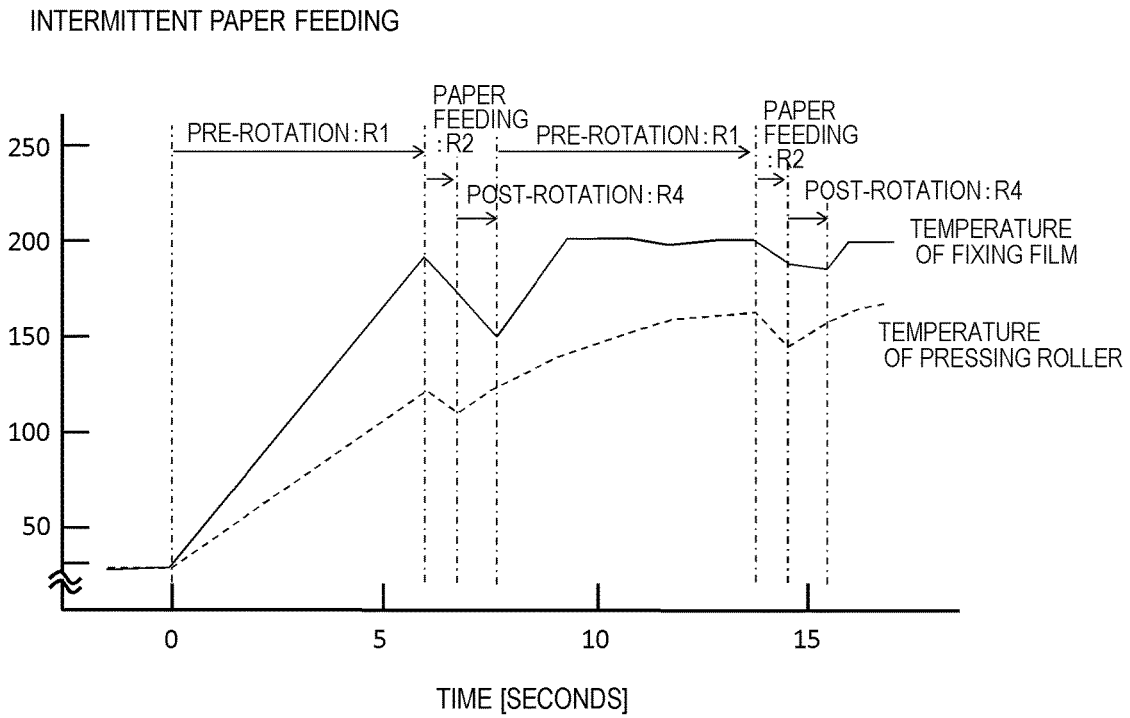
FIG. 5 is a graph for describing the temperature of the members in the case of intermittent paper feeding in the first embodiment.

Next, FIG. 5 shows the case of intermittent paper feeding in which the temperature of the fixing unit 6 becomes high. In FIG. 5, the representation of a horizontal axis, a vertical axis, a solid line, and a broken line is the same as that of FIG. 4.

FIG. 5 shows the temperature transitions of the fixing film 13 and the pressing roller 20 when one sheet is printed for every 8 seconds.

According to the configuration of the first embodiment, the pre-rotation step starts immediately after the post-rotation of the printing of the first paper ends when one sheet is printed for every 8 seconds. In this case, since the fixing unit 6 has been already heated, the control temperature reaches 200° C. immediately after the heater 11 starts warming-up. Since it takes 6 seconds to perform image formation and paper transporting, however, the fixing film 13 and the pressing roller 20 are on standby while the heater 11 maintains a temperature of 200° C. While the heater 11 is on standby, the fixing film 13 and the pressing roller 20 rotate. This is because, if the fixing film 13 and the pressing roller 20 are on standby in a stopped state while the heater 11 maintains the high temperature, local heat history (deformation) is left in the fixing film 13 and the pressing roller 20, resulting in an influence on an image.

Since the heater 11 maintains a temperature of 200° C. for a long time in the period R1 of the pre-rotation, the temperature of the fixing film 13 reaches 200° C. almost equivalent to the control temperature. Since the pressing roller 20 rotates in a state of contacting the fixing film 13 having the high temperature, the temperature of the pressing roller 20 also increases and becomes about 160° C. In a state in which the temperature of the fixing film 13 and the pressing roller 20 becomes high, as described above, the wearing of the fixing film 13 accelerates and a reduction in the hardness of the pressing roller 20 is promoted, resulting in a likelihood that problems, such as a hot offset, curling, and paper wrinkling, occur before the fixing unit 6 comes to the end the life (150,000 sheets).

In addition, in the case of the intermittent paper feeding shown in FIG. 5, the temperature of the fixing film 13 may reach 200° C. at a timing at which the tip end of the recording material P enters the fixing nip portion. At this time, it appears from FIG. 6 that the wearing amount for every 1000 (1 k) sheets is 0.13 μm. When 150,000 sheets are printed, the wearing amount becomes 19.5 nm. As a result, the surface layer is almost shaved.

On the other hand, since the pressing roller 20 rotates at a temperature of 160° C., the hardness of the pressing roller 20 reduces by 1.7° for every 100 hours until 100,000 sheets are printed. After that, the hardness of the pressing roller 20 reduces by 0.9° for every 100 hours. When 150,000 sheets are intermittently printed, the pressing roller 20 and the fixing film 13 rotate for 333 hours. Therefore, for the later half 233 hours, the hardness of the pressing roller 20 reduces by a hardness reduction rate (0.9°/100 hours).

As a result, the hardness of the pressing roller 20 becomes about 51° at a point at which 150,000 sheets have been printed and reduces to about 50° equivalent to the lower limit of the hardness at which the pressing roller is allowed to be driven. Therefore, the motor does not have room in terms of durability.

In a method in which the life alert of the fixing unit 6 is displayed on the operation panel of a product body or a PC monitor depending on the number of counted printed recording materials P, a timing at which the life alert is issued deviates from a timing at which the fixing unit 6 comes to the end of the life. Therefore, there is a possibility that an alert is not appropriately issued to a user and paper jamming due to a stain on the surface of the paper or a driving failure occurs.

(6) Control of Embodiment

Accordingly, in the first embodiment, the CPU 100 monitors the surface temperature of the fixing film 13 and the surface temperature of the pressing roller 20 with the first temperature sensor 31 and the second temperature sensor 32, respectively, calculates the wearing amount of the surface layer of the fixing film 13 and a change in the hardness of the pressing roller 20 for every time printing is performed of one sheet corresponding to the surface temperature, and predicts the thickness of the surface layer of the fixing film 13 and the hardness of the pressing roller 20 at the measurement of the temperature. The CPU 100 serves as a wearing amount acquisition portion that acquires the wearing amount of the surface layer of the fixing film 13, and serves as a hardness change amount acquisition portion that acquires the hardness change amount per unit time of the pressing roller 20. In addition, the CPU 100 serves as a control temperature setting portion that sets the control temperature of the heater 11 according to the wearing amount of the surface layer of the fixing film 13, and the hardness change amount of the pressing roller 20 and serves as a life calculation portion that calculates the life of the fixing film 13 and the pressing roller 20 according to the wearing amount of the surface layer of the fixing film 13 and the hardness change amount of the pressing roller 20. Further, the CPU 100 sets the control temperature according to predicted information on the thickness of the surface layer of the fixing film 13 and the hardness of the pressing roller 20 to prevent the occurrence of an image failure and to issue a life alert at an appropriate timing.

Specifically, as for the thickness of the surface layer of the fixing film 13, a coefficient corresponding to the wearing amount of the surface according to the surface temperature of the fixing film 13 is subtracted from an initial value for every paper printing. Then, based on the calculation result, the control temperature is changed and the life is displayed.

As for the pressing roller 20, a coefficient corresponding to the hardness change amount according to the surface temperature of the pressing roller 20 is subtracted from an initial value for every unit time. Then, based on the calculation result, the control temperature is changed and the life is displayed.

The calculation results are stored in the storage medium 33 attached to the fixing unit 6.

In displaying the life, one of the fixing film 13 and the pressing roller 20 that has come more closely to the end of the life is selected. In addition, the display of the life may be performed at a point at which the fixing film 13 and the pressing roller 20 have come to the end of the life, or may be performed in such a way as to display the ratio of the consumption of the fixing film 13 and the pressing roller 20 to the length of the life.

Specific Procedure for Estimating (Predicting) Thickness of Surface Layer of Fixing Film 13

Next, a description will be given of a procedure for calculating the thickness of the surface layer of the fixing film 13. First, a thickness coefficient T corresponding to the thickness of the surface layer of the fixing film 13 is calculated. It is assumed that the initial value of the thickness coefficient T is 2,000,000. The initial value may be changed according to the initial thickness of the surface layer of the fixing film 13. In this case, the initial value is increased or decreased at a rate of 100,000 for every 1 μm thickness. The initial value is stored in the storage medium 33 of the fixing unit 6. The coefficient is subtracted from the thickness coefficient T such that the thickness coefficient T is updated for every time printing is performed. Any of values shown in table 2 is used as the subtraction coefficient in the first embodiment. The subtraction coefficient is the wearing amount of the surface layer corresponding to the surface temperature of the fixing film 13.

The subtraction coefficient in table 2 is subtracted from the initial value of the thickness coefficient T for every time printing is performed, and the value is stored in the storage medium 33 of the fixing unit 6.

Note that the wearing amount is different depending on how the surface layer of the fixing film 13 receives heat history, and thus, it is necessary to assume a case considering only the elastic deformation and a case considering both the elastic deformation and the viscosity deformation. The subtraction coefficients shown in table 2 refer to the case considering both the elastic deformation and the viscosity deformation. It is assumed that a subtraction coefficient considering only the elastic deformation is "5" in the first embodiment. A period at which the subtraction coefficient considering only the elastic deformation is different according to the surface temperature of the fixing film 13. Table 3 shows the relationship between the surface temperature and the time at which the subtraction coefficient "5" is applied.

When printing is performed at room temperature in a state in which the surface temperature is 40° C. or less, the subtraction coefficient "5" is used for the first two sheets according to the time shown in table 3.

Therefore, when three sheets are printed, the fixing unit 6 is left unattended until being cooled, and printing is performed again, the subtraction coefficient "5" is used again.

When printing is continuously performed with the fixing unit 6 warmed up as in continuous printing, the printing is greatly influenced by the subtraction coefficients in table 2, but is hardly influenced by the subtraction conditions in table 3 depending on the number of printed sheets.

TABLE 2

Subtraction Coefficient of Surface Layer of Fixing Film (Considering Elastic Deformation and Viscosity Deformation)

| Surface temperature of fixing film | Subtraction coefficient |
|---|---|
| Less than 180° C. | 7 |
| 180° C. or more and less than 190° C. | 9 |
| 190° C. or more and less than 200° C. | 13 |
| 200° C. or more | 18 |

TABLE 3

| Applied Time of Subtraction Coefficient to Surface Layer of Fixing Film (Considering Only Elastic Deformation) | |
|---|---|
| Surface temperature of fixing film | Applied time of coefficient [seconds] |
| Less than 160° C. | No time limit |
| 160° C. or more and less than 175° C. | 6 |
| 175° C. or more and less than 200° C. | 3.5 |
| 200° C. or more | 1 |

Next, the control temperature of the heater 11 is determined from the value of the thickness coefficient T corresponding to the thickness of the surface layer (predicted information on the thickness of the surface layer) of the fixing film 13. The control temperature is determined so that the temperature of the film surface becomes 180° C. at the continuous paper printing.

When the relationship between the thickness of the surface layer of the fixing film 13 and the control temperature at which the film surface is set at 180° C. in the first embodiment is calculated by approximation from FIG. 7, the following formula 1 is established.

Control temperature (° C.)=0.8×thickness (μm) of surface layer of film+184(° C.) (Formula 1)

When formula 1 is converted into a coefficient formula, the following formula 2 is established.

Control temperature (° C.)=0.8×thickness coefficient $T$×100,000+184(° C.) (Formula 2)

In controlling the temperature, the calculation may be performed. Alternatively, the temperature may be controlled based on a correspondence table, as shown in table 4 below.

TABLE 4

| Correspondence between Thickness Coefficient T and Control temperature | |
|---|---|
| Thickness coefficient T | Control temperature [° C.] |
| 2,000,000~1600001 | 200 |
| 1,600,000~1,200,001 | 197 |
| 1,200,000~800,001 | 193 |
| 800,000~400,001 | 190 |
| 400,000 or less | 187 |

Next, a description will be given of displaying the life of the fixing film 13. In displaying the life, settings are made with some margins. This is because an image failure, such as an image stain, occurs even when the surface layer of the fixing film 13 is slightly shaved.

In the first embodiment, it is determined that the fixing film 13 has come to the end of the life at a point at which the remaining surface layer of the fixing film 13 has had a thickness of 4 μm. That is, the remaining thickness is set at 4 μm. The value corresponds to 400,000 in terms of a thickness coefficient.

When the life is displayed by a ratio, it is assumed that the initial value of the thickness coefficient T is 100% and the coefficient 400,000 corresponding to the remaining thickness is 0%. For example, when the initial thickness coefficient T is 2,000,000, the display of the life may be reduced by 1% every time the thickness coefficient T is reduced by 16,000.

When the ratio display is not performed, the life of the fixing unit 6 may be displayed at a point at which the thickness coefficient has come to 400,000.

Next, a description will be given of the pressing roller 20. First, a hardness coefficient D corresponding to the hardness of the pressing roller 20 is calculated. In the first embodiment, the pressing roller has a hardness of 55° in its brand-new state. In addition, the subtraction coefficient of hardness per 1° is set as 10,000,000. Therefore, the initial value of the hardness coefficient D of the pressing roller 20 is 550,000,000. The value may be changed according to the initial hardness of the pressing roller 20. In this case, the initial coefficient is increased or decreased at a ratio of 10,000,000 relative to the hardness 1° of the pressing roller and is stored in the storage medium 33 of the fixing unit 6.

In the calculation, the coefficient is subtracted every time printing is performed. The subtraction of the hardness coefficient D of the pressing roller 20 is performed every 1 second when the pressing roller 20 rotates, and the coefficient is changed, as shown in table 5, according to temperature. In table 5, a hardness change amount per rotating time corresponding to the surface temperature of the pressing roller 20 is set in advance.

Figure 10:
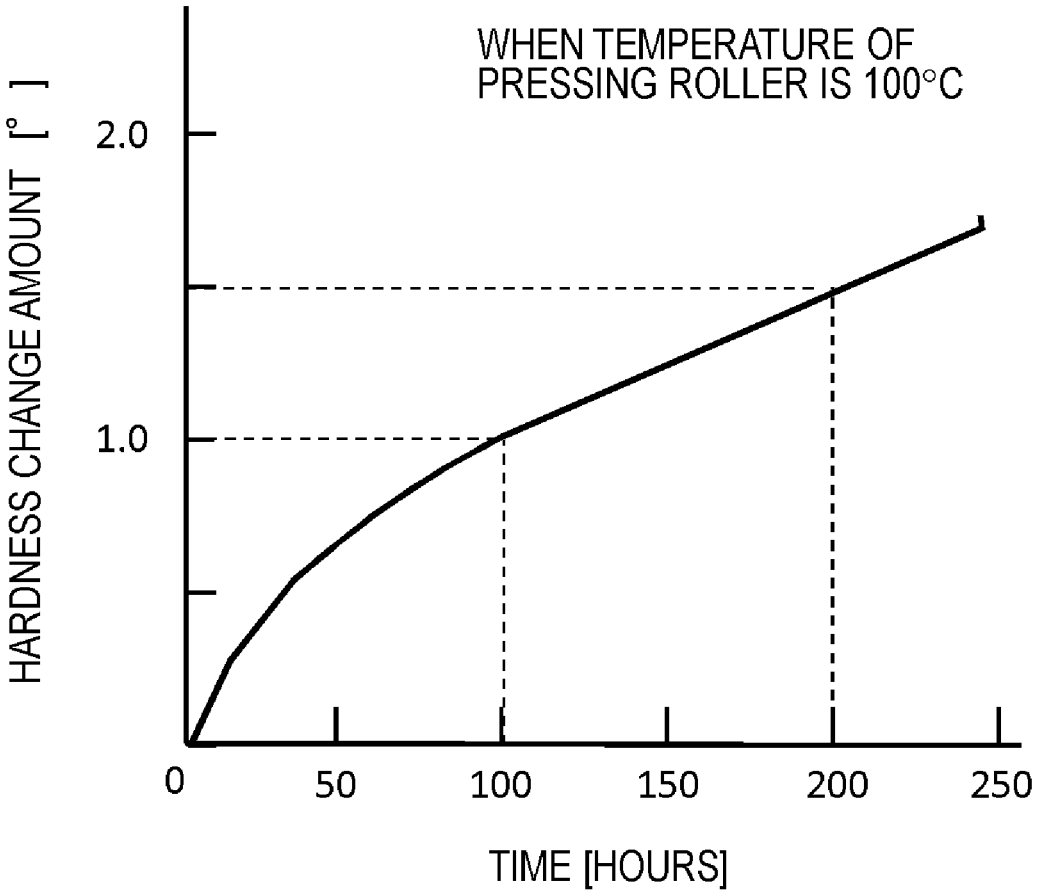
FIG. 10 is a graph showing the relationship between the use time and the change in the hardness of the pressing roller.

Note that, as shown in FIG. 10, a change in the hardness of the pressing roller 20 is great until 100 hours in the early stage of the rotating time, and then the change amount becomes small.

This is because a PFA tube coating the surface of the pressing roller 20 expands in the period of the early stage and thus, the hardness reduces as the tension of the surface weakens. Therefore, it is estimated that the hardness change amount in the early stage becomes great.

On the other hand, since the hardness reduces only with rubber after the early stage, it is estimated that the hardness change amount becomes relatively small.

TABLE 5

| Subtraction Coefficient of Hardness of Pressing roller | | |
|---|---|---|
| Temperature of pressing roller | Subtraction coefficient (100 hours from early stage) | Subtraction coefficient (after 100 hours) |
| Less than 100° C. | 28 | 14 |
| 100° C. or more and less than 150° C. | 42 | 21 |
| 150° C. or more and less than 185° C. | 70 | 35 |
| 185° C. or more | 100 | 50 |

Next, the control temperature is corrected based on the value of the hardness coefficient D (predicted information on the hardness) of the pressing roller 20.

In correcting the control temperature, a correspondence table shown in table 6 is used. For example, the control temperature is 193° C. when the thickness coefficient T of the fixing film 13 is 1,000,000. When the hardness coefficient D of the pressing roller 20 is 535,000,000, however, the control temperature is reduced by 2° C. to be set at 191° C.

TABLE 6

| Hardness Coefficient D of Pressing roller and Correction Amounts of Control temperature | |
|---|---|
| Coefficient D | Correction amount of control temperature [°] |
| 550,000,000~540,000,001 | 0 |
| 540,000,000~530,000,001 | −2 |

TABLE 6-continued

| Hardness Coefficient D of Pressing roller and Correction Amounts of Control temperature | |
|---|---|
| Coefficient D | Correction amount of control temperature [°] |
| 530,000,000~520,000,001 | −3 |
| 520,000,000 or less | −4 |

Next, a description will be given of displaying the life of the pressing roller 20. When the hardness of the pressing roller 20 is below 50°, a rotation failure caused when a rotation load torque becomes great occurs in the driving motor adopted in the apparatus of the first embodiment. Before the rotation failure occurs, it is necessary to issue a life alert. It is assumed that the hardness at the use lower limit of the pressing roller 20 with which the motor adopted in the apparatus of the first embodiment normally operates is 51°. The hardness corresponds to 510,000,000 in terms of the hardness coefficient D.

When the life is displayed by ratio, it is assumed that the initial value of the hardness coefficient D is 100% and the hardness coefficient 510,000,000 corresponding to the use lower limit is 0%. For example, when the hardness coefficient D in the early stage is 550,000,000, the display of the life may be decreased by 1% every time the hardness coefficient D decreases by 400,000.

When the ratio display is not performed, the life of the fixing unit 6 may be displayed at a point at which the thickness coefficient has come to 510,000,000.

(7) Effects of Embodiment

According to the above procedure, the control temperature may be set at appropriate temperature even when the wearing speed of the surface layer of the fixing film 13 changes, or even when the speed of a change in the hardness of the pressing roller 20 changes depending on use conditions. Thus, the temperature of the fixing nip portion may be appropriately maintained, and excellent printing may be performed without causing problems such as a hot offset and curling.

In addition, in terms of the life of the fixing unit 6, life management may be performed based on the thickness of the surface layer of the fixing film 13 and the hardness of the pressing roller 20. Therefore, unlike a method in which the life is estimated based only on the number of printed sheets, the fixing unit 6 that has not come to the end of the life may be continuously used without being discarded. In addition, when the fixing unit 6 is used under conditions severe with regard to the wearing of the fixing film 13 and a change in the hardness of the pressing roller 20, a life alert may be appropriately issued according to the statuses of the components.

Hereafter, a description will be given of specific calculation for determining an appropriate control temperature and a specific calculation for performing appropriate life management under different use conditions. In addition, a description will be given of effects under the respective use conditions.

Figure 15:
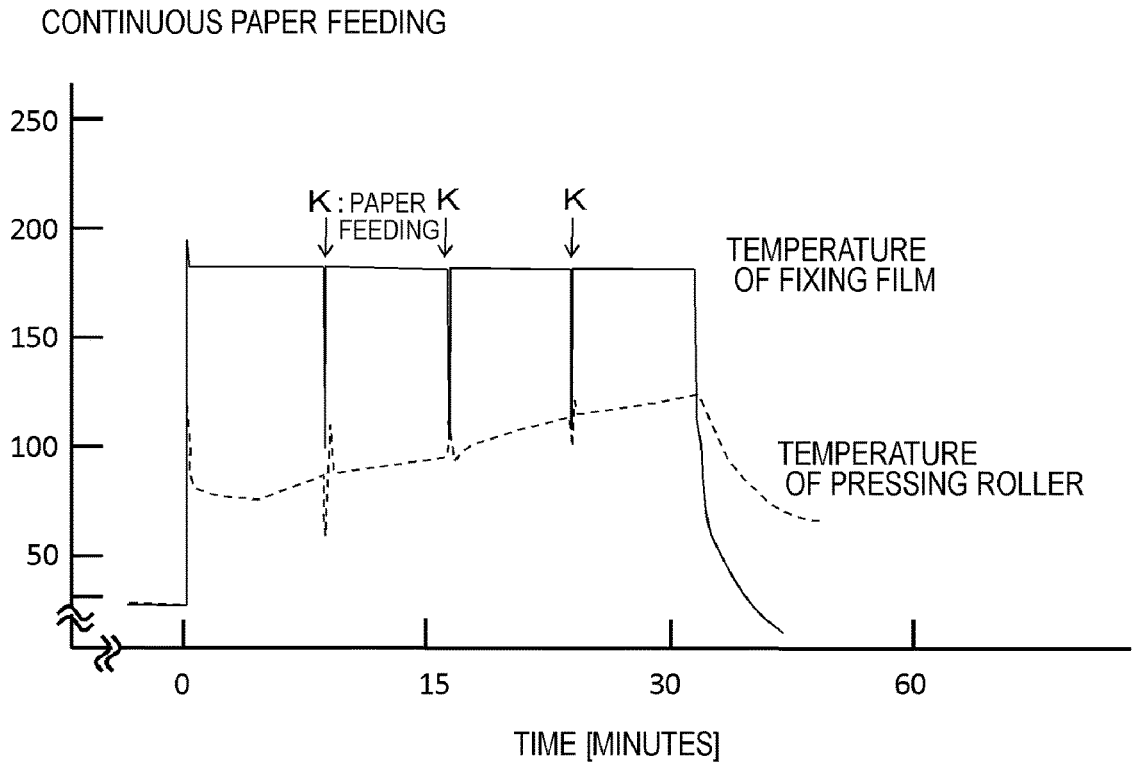
FIG. 15 is a graph for describing the temperature of the members in the case of the continuous paper feeding in the first embodiment.

First, FIG. 15 shows the temperature transitions of the fixing film 13 and the pressing roller 20 when 60 sheets are continuously printed per minute (continuous paper feeding) as shown in FIG. 4.

In FIG. 15, a horizontal axis shows time, a vertical axis shows temperature, a solid line shows the temperature of the fixing film 13, a broken line shows the temperature of the pressing roller 20, and K shows a timing at which the apparatus temporarily stops for paper feeding. In the graph, an average temperature is shown for every 5 seconds.

In the continuous printing, the temperature of the pressing roller 20 gently decreases until about 50 sheets are printed but then gently increases. This is because the temperature of the pressing roller 20 gradually increases with heat supplied from the heater 11 to the pressing roller 20 between the sheets of paper and the pressing roller 20 is heated throughout.

An appropriate control temperature corresponding to reduction in the thickness of the surface layer of the fixing film 13 is calculated as follows. Under the paper feeding conditions, the temperature of the fixing film 13 transitions at 180° C. At this temperature, the subtraction coefficient per sheet is 9 based on table 2.

For example, the thickness coefficient T at a point at which 10,000 sheets have been printed is calculated as follows: 2,000,000−9×10,000=1,910,000.

When the thickness coefficient T is 1,910,000, the control temperature is 200° C. from table 4.

In addition, an appropriate control temperature corresponding to reduction in the hardness of the pressing roller 20 is calculated as follows.

Under the paper feeding conditions, the temperature of the pressing roller 20 does not reach 150° C. At this temperature, the subtraction coefficient is 42 based on table 5. It takes 10,000 seconds to continuously feed 10,000 sheets. The hardness coefficient D of the pressing roller 20 at this time is as follows: 550,000,000−42×10,000=549,580,000.

In this case, the control temperature does not change due to the hardness of the pressing roller 20. Accordingly, the control temperature at a point at which 10,000 sheets have been printed is 200° C.

As described above, the control temperature calculated in terms of the reduction in the thickness of the surface layer of the fixing film 13 is 200° C., and the control temperature calculated in terms of the reduction in the hardness of the pressing roller 20 is also 200° C. Accordingly, it is determined that the appropriate control temperature at a point at which 10,000 sheets have been fed is 200° C.

Next, a description will be given of the life of the fixing unit 6. When calculation is performed using the subtraction coefficient 9 until the thickness coefficient T of the fixing film 13 changes from 2,000,000 to 400,000, the fixing film 13 is allowed to print 178,000 sheets at a point at which 10,000 sheets have been printed as described below: (2,000,000−400,000)/9≈178,000.

As for the pressing roller 20, a time required when the hardness coefficient D changes from 550,000,000 to 510,000,000 and the number of printable sheets at a point at which 10,000 sheets have been printed are calculated as follows: Pressing roller rotating time: (550,000,000−510,000,000)/42=952,380 (seconds)=264 hours.

In the first embodiment, 60 sheets are printed per minute, and one sheet is printed per second. That is, the number of printable sheets calculated from the life of the pressing roller 20 is 952,000 at a point at which 10,000 sheets have been printed.

When the life of the fixing film 13 is compared with that of the pressing roller 20 based on the number of usable sheets (printable sheets) representing a value converted into the number of used recording materials P (printed sheets), the number of the usable sheets of the fixing film 13 is less than that of the pressing roller 20 in the first embodiment. Therefore, the life of the fixing film 13 is regarded as the life of the fixing unit 6.

Accordingly, the control temperature and the life under the paper feeding condition are as follows: Control temperature at point at which 10,000 sheets have been printed: 200° C., and the number of usable sheets (printable sheets) of the fixing unit 13 until the end of the life at point at which 10,000 sheets have been printed: 178,000 sheets.

As described above, the wearing of the fixing film 13 and a change in the hardness of the pressing roller 20 are small in the case of the continuous paper feeding. Therefore, a change amount of the control temperature is small, and the number of the usable sheets of the fixing unit 6 is 178,000 greater than the expected number 150,000.

Figure 16:
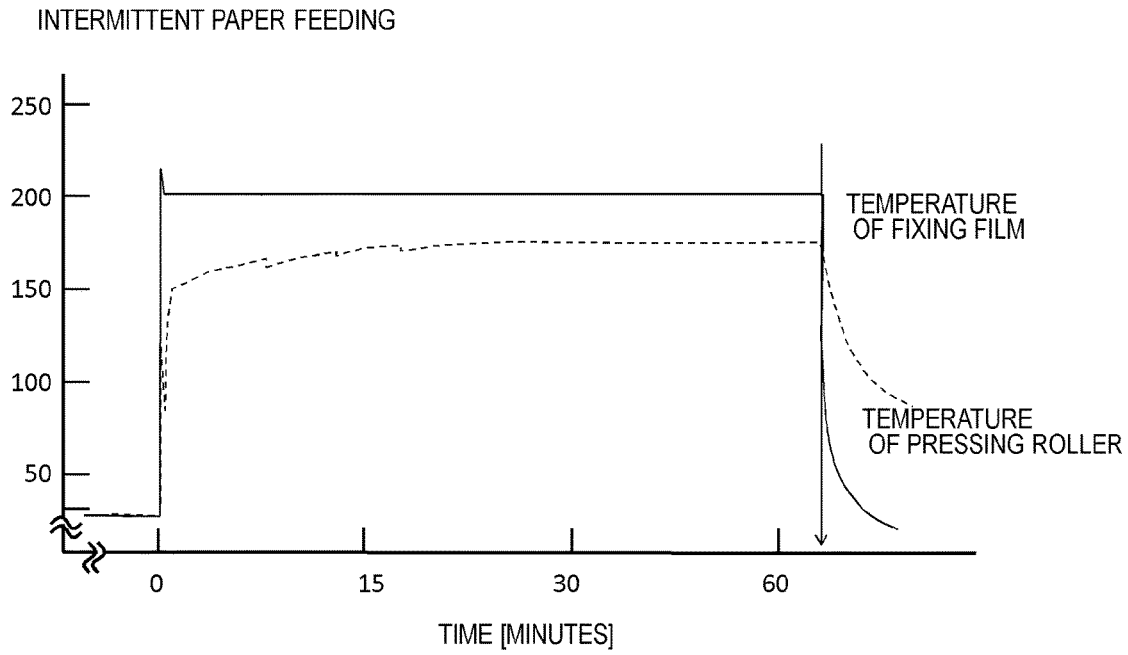
FIG. 16 is a graph for describing the temperature of the members in the case of the intermittent paper feeding in the first embodiment.

Next, FIG. 16 shows the temperature transitions of the fixing film 13 and the pressing roller 20 when two sheets are repeatedly continuously printed for every 8 seconds (intermittent printing) in a state in which the fixing unit 6 has been cooled as shown in FIG. 5. An increase in the temperature of the pressing roller 20 is greater than that in the case of the continuous paper feeding shown in FIG. 15.

Under the paper feeding condition, the temperature of the fixing film 13 transitions at 200° C. At the temperature, the subtraction coefficient per sheet is 18 based on table 2.

For example, the thickness coefficient T at a point at which 10,000 sheets have been printed is calculated as follows: 2,000,000−18×10,000=1,820,000.

When the thickness coefficient T is 1,820,000, it is determined from table 4 that the control temperature is 200° C.

In addition, under the paper feeding condition, the temperature of the pressing roller 20 is 175° C. At the temperature, the subtraction coefficient is 70 from table 5. In the case of the intermittent printing, it takes 8 seconds to feed one sheet. Therefore, it takes 80,000 seconds to feed 10,000 sheets. At this time, the hardness coefficient D of the pressing roller 20 is as follows: 550,000,000−70×80,000=544,400,000.

In this case, with reference table 6, a correction amount of the control temperature due to a reduction in the hardness of the pressing roller 20 is 0° C.

As a result, the control temperature at a point at which 10,000 sheets have been printed is 200° C.

Accordingly, under the paper feeding condition of the intermittent printing as well, the control temperature calculated in terms of reduction in the thickness of the surface layer of the fixing film 13 is 200° C., and the control temperature calculated in terms of reduction in the hardness of the pressing roller 20 is 200° C. as described above. Accordingly, it is determined that the control temperature at a point at which 10,000 sheets have been fed is 200° C.

When the same calculation is performed at a point at which 20,000 sheets have been fed, the control temperature determined based on reduction in the thickness of the surface layer of the fixing film 13 is 200° C. and the control temperature determined based on reduction in the hardness of the pressing roller 20 is 198° C. In this case, the control temperature determined based on reduction in the hardness of the pressing roller 20 is selected, and thus, is controlled at 198° C.

In addition, a description will be given of a method for calculating the life of the fixing unit 6 in the case of the intermittent printing. First, the number of the usable sheets of the fixing film 13 at a point at which 10,000 sheets have been printed is 89,000 as described below when calculated by the subtraction coefficient 18 until the thickness coefficient T of the fixing film changes from 2,000,000 to 400,000.

$$(2{,}000{,}000-400{,}000)/18\approx 89{,}000$$

Next, a description will be given of the number of the usable sheets of the pressing roller 20 at a point at which 10,000 sheets have been printed. A time required when the hardness coefficient D of the pressing roller 20 changes from 550,000,000 to 510,000,000 and the number of printable sheets at a point at which 10,000 sheets have been printed are calculated as follows.

Based on table 5, the number of printable sheets is calculated by the subtraction coefficient 70 for the early 100 hours.

After that, the number of printable sheets is calculated as follows by the subtraction coefficient 35:

$$100\times 60\times 60+(550{,}000{,}000-510{,}000{,}000-70\times 100\times 60\times 60)/35=360{,}000+422{,}857$$

$$=782{,}857\ \text{(seconds)}=217\ \text{hours}$$

From here, the number of printable sheets is calculated as follows since it takes 8 seconds to print one sheet: 782,857 (seconds)/8 (second/sheet)=97,857 (sheets).

The number of printable sheets at a point at which 10,000 sheets have been printed is 98,000.

When the number of the printable sheets of the fixing film 13 and the number of the printable sheets of the pressing roller 20 are taken into consideration, the number of the printable sheets of the fixing film 13 is smaller. Therefore, the life of the fixing film 13 is regarded as the life of the fixing unit 6.

Accordingly, the control temperature and the life of the fixing unit under the paper feeding condition are as follows: Control temperature at point at which 10,000 sheets have been printed: 200° C., Control temperature at point at which 20,000 sheets have been printed: 198° C., Life of fixing unit 6 at point at which 10,000 sheets have been printed: 89,000 sheets Under a severe use condition in which an increase in the temperature of the pressing roller 20 is great, as shown in FIG. 16, a timing at which the life of the fixing unit 6 is notified is made earlier than a case in which the first embodiment is not adopted, but the wearing of the surface layer of the fixing film 13 and an image failure due to reduction in the hardness of the pressing roller 20 may be prevented.

In addition, an alert may be issued before the apparatus stops due to an image stain or paper jamming due to the wearing of the fixing film 13 and the reduction in the hardness of the pressing roller 20. As described above, a user or the manager of a network printer may be notified of the life at an accurate timing to urge the replacement of the fixing unit 6.

The above embodiment describes the method for determining the control temperature and the method for calculating the notification of the life and their effects using a use mode in which the continuous printing, as shown in FIG. 15, is performed at all times and a use mode in which the intermittent printing, as shown in FIG. 16, is performed at all times as examples. A user's actual use mode is, however, a complicated mode in which the continuous printing and the intermittent printing are alternately mixed together. Accordingly, calculation corresponding to an individual use mode may be performed for every print job, every prescribed time, or every prescribed number of sheets of fed paper. Further, it is possible to perform optimum control and accurate life counting by sequentially accumulating and updating results in the storage medium 33 of the fixing unit 6.

Figure 17:
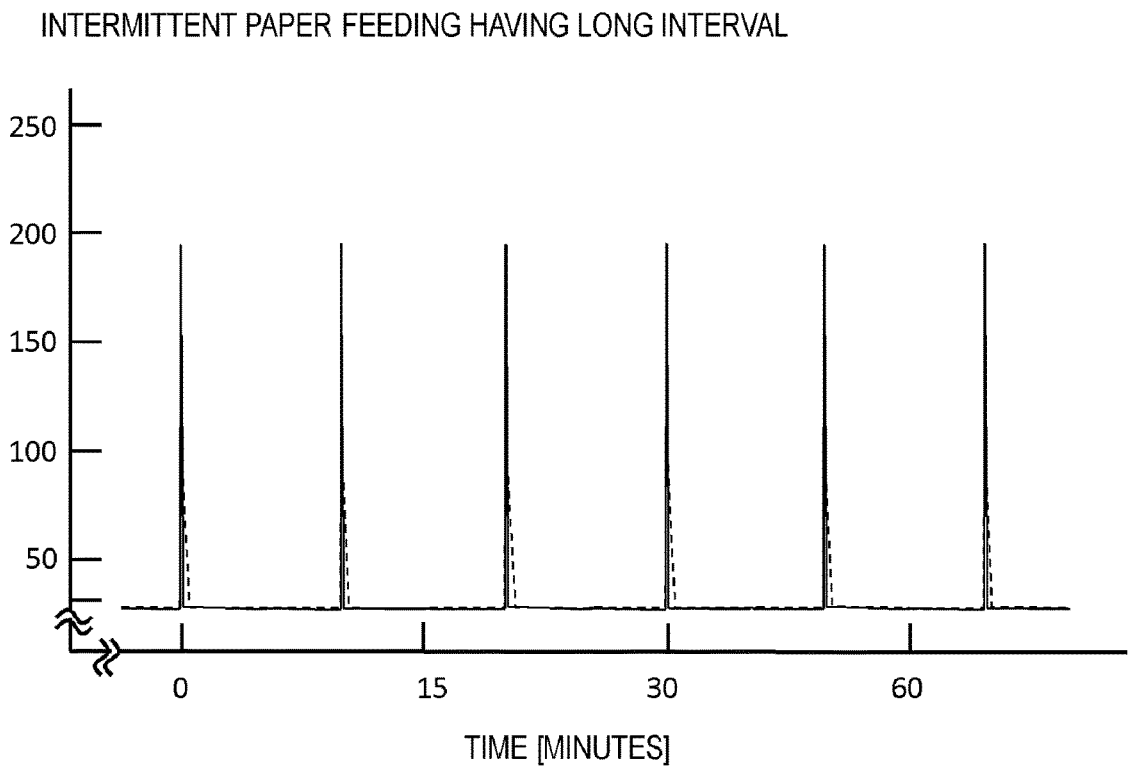
FIG. 17 is a graph for describing the temperature of the members in the case of intermittent paper feeding having a long interval in the first embodiment.

Moreover, FIG. 17 shows temperature transitions when one sheet is printed for every 10 minutes. Like this, the fixing unit 6 is naturally cooled when the apparatus stops for a long time in operation. Even if printing is continued in this state, the fixing unit 6 is not influenced by the heat of the preceding fed paper. Therefore, both the temperature of the fixing film 13 and the temperature of the pressing roller 20 are constantly low at the start of the printing.

A pre-rotating operation is performed for every time printing is performed, but the fixing unit 6 is not rotationally driven until the temperature of the heater 11 becomes 170° C. Therefore, the number of the rotations of the fixing unit 6 is small. When the first embodiment is applied to such a use mode, the rotating time of the pressing roller 20 becomes short. Therefore, the reduction in the hardness of the pressing roller 20 is smaller than that of the case of the continuous paper feeding and does not have an influence on the control temperature.

In addition, it takes 8 seconds for the fixing film 13 to perform printing, and the printing ends before PFA of the surface layer causes viscosity deformation in a printing step. Therefore, a wearing amount becomes smaller than that of the case of the continuous printing.

The life (number of printable sheets) of the fixing film 13 at a point at which 10,000 sheets have been printed is about 320,000.

In view of the circumstances, a change in the control temperature becomes smaller and durability becomes longer in such a use mode as compared with a case in which the apparatus is continuously operated.

(8) Other Applied Examples of Embodiment

The temperature of the fixing film 13 and the pressing roller 20 is actually measured by thermopiles in the first embodiment, but the temperatures may be predicted based on a paper feeding history, or the like.

For example, in the configuration of the first embodiment, the surface temperature of the fixing film 13 is set at 190° C. for the first paper and set at 180° C. for the second and subsequent sheets when the continuous paper feeding as shown in FIG. 4 is performed. In addition, the surface temperature of the fixing film 13 is set at the same temperature as the control temperature when the intermittent printing as shown in FIG. 5 is performed.

Meanwhile, as for the temperature of the pressing roller 20, one printing step is divided into temporal segments, such as a pre-rotation period, a paper feeding period, an inter-paper period, and a post-rotation period. Further, in consideration of the amount of heat supplied from the fixing film 13 to the pressing roller 20, the amount of heat released into air, or the like, in the respective periods, the temperature of the pressing roller 20 may be estimated from the total value of the amount of the heat supplied, the amount of the heat released, or the like. For example, the temperature of the pressing roller 20 is estimated as follows:

(i) The operation of the body is temporally divided into pre-rotation, inter-paper, paper feeding, and standby segments, (ii) As shown in table 7, a coefficient is set for each of the segments, (iii) Every time 100 msec elapse in each of the segments, the coefficient is added, (iv) The added coefficient is stored as a total count, and (v) The total count is used as the temperature of each component.

An initial value is determined from the temperature of the thermistor 15 provided on the rear surface of the heater 11.

TABLE 7

Coefficients for Estimating Temperature of Pressing roller

| | Added coefficient | | | |
|---|---|---|---|---|
| Segment | When total value of coefficient is 0~110 | When total value of coefficient is 110~170 | When total value of coefficient is 170~220 | Movement of heat |
| Pre-rotation | | +18 | | Energization of heater |
| Inter-paper | | +3 | | Heater suppressing energization |
| Post-rotation, stop | −1 | −5 | −10 | Heater off |
| Paper feeding | −0.8 | −1 | −2 | Transfer of heat to paper |

With the setting and the totalization of the coefficients, the temperature of the pressing roller 20 may be estimated.

As for the temperature of the fixing film 13, the estimation of the temperature is made possible with the setting of dedicated coefficients.

In addition, the thickness coefficient T of the fixing film 13 and the hardness coefficient D of the pressing roller 20 are stored in the storage medium 33 attached to the fixing unit 6 in the first embodiment, but may be stored in a storage medium on the side of the body of the image forming apparatus. For example, in the case of an image forming apparatus in which a fixing unit is not replaceable, a memory in the body of the image forming apparatus may be used. Further, in a case in which a fixing unit is replaceable and has a plurality of electrodes and individual discrimination means for discriminating the individual type of the fixing unit according to the open/short state between the plurality of electrodes is provided, a memory in the body of an image forming apparatus may be used.

The temperature of the fixing film 13 and the temperature of the pressing roller 20 are monitored and used for both the control temperature and the life detection in the first embodiment, but the temperatures may be used for one of the control temperature and the life detection depending on the configuration of the apparatus. In consideration of the durability of the fixing film 13 and the pressing roller 20, it is possible to determine whether the temperature of the fixing film 13 and the temperature of the pressing roller 20 are used for both or one of the control temperature and the life detection.

Second Embodiment

Next, a description will be given of a second embodiment of the present invention. In the case of a small image forming apparatus, an engine controller having high processing performance may not be often used to miniaturize electrical components for controlling a body. In addition, a fixing unit is fixed to the body of the image forming apparatus and is not often configured as a replaceable component. An example of performing a configuration proposed in the second embodiment in such an image forming apparatus will be described.

Figure 11:
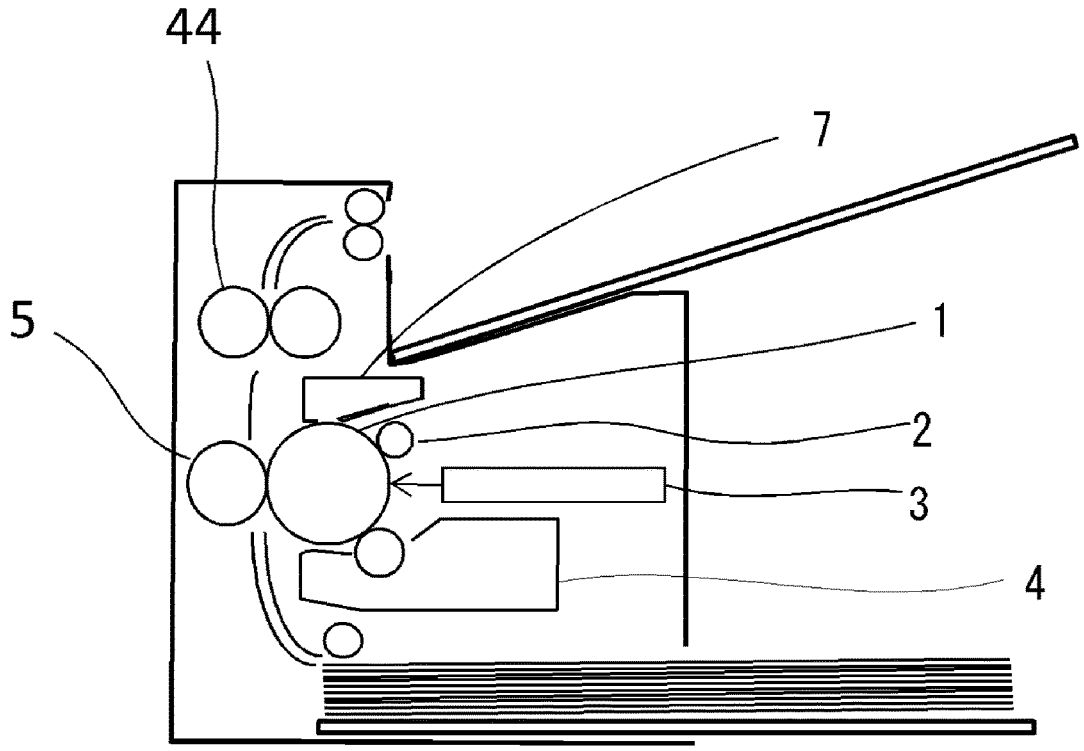
FIG. 11 is a schematic configuration view of an image forming apparatus according to a second embodiment.

FIG. 11 shows an image forming apparatus according to the second embodiment. The same constituents as those of the first embodiment will be shown by the same symbols, and their descriptions will be omitted. The image forming apparatus according to the second embodiment prints 15 sheets of A4-size in vertical feeding per minute. The paper transporting speed of the image forming apparatus is 100 mm/second in image formation. The configuration of a fixing unit 44 is different from that of the first embodiment.

Figure 12:
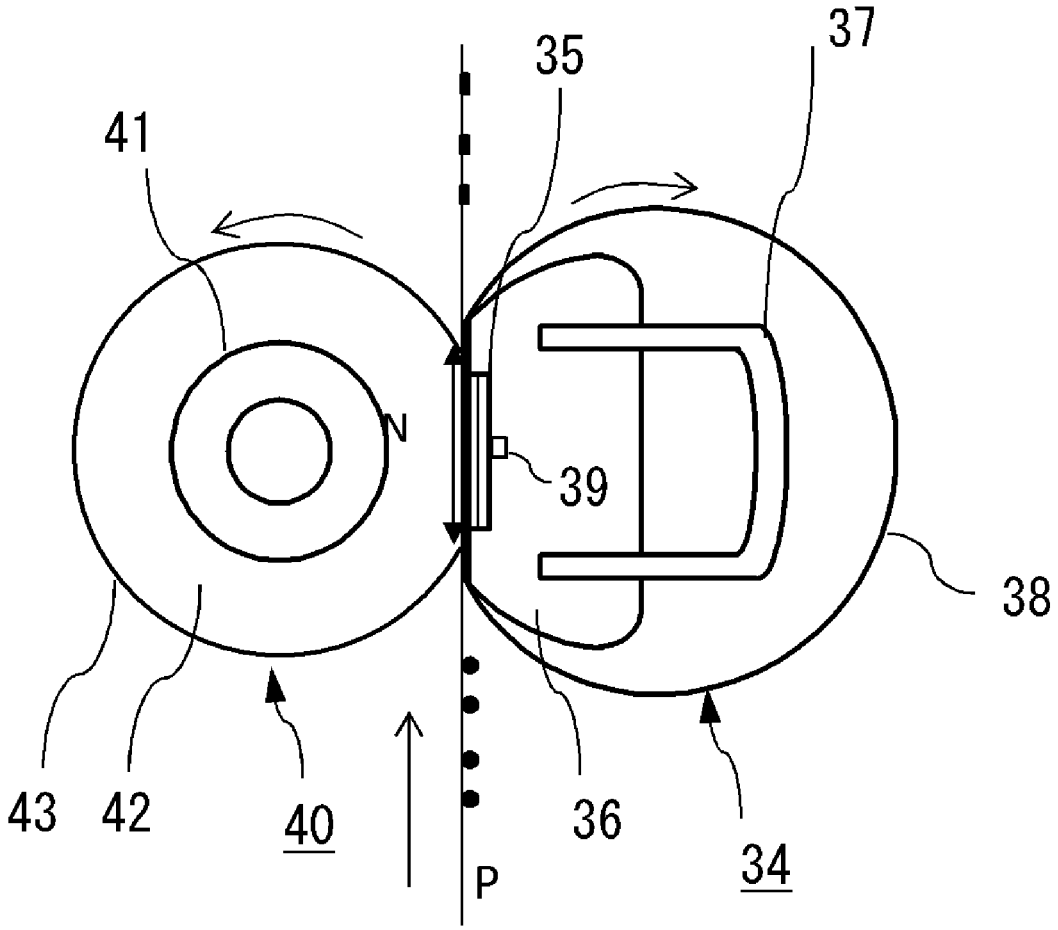
FIG. 12 is a schematic configuration view of a fixing unit shown in FIG. 11.

FIG. 12 shows a cross-sectional view of the fixing unit 44. The fixing unit 44 includes a heating unit 34 provided with a heater 35 serving as a heating source and a cylindrical fixing film (fixing rotating member) 38 and a pressing roller 40 serving as a pressing member. A fixing nip portion N is formed by bringing the heater 35 and the pressing roller 40 into contact with each other at a prescribed pressing force via the fixing film 38.

The heating unit 34 is mainly constituted of the fixing film 38, the heater 35, a heat insulating holder 36 that holds the heater 35, a metal stay 37, or the like. The metal stay 37 receives a pressing force from a spring (not shown) and presses the heat insulating holder 36 toward the pressing roller 40. Note that reference symbol 39 shows a thermistor attached onto the rear side of the heater 35 and detects the temperature of the heater 35.

The heater 35 is a ceramic heater and has a thickness of 1 mm and a width of 5 mm. The heater 35 is one obtained by forming a heat generating layer on an alumina substrate.

The fixing film 38 has an outer diameter of 18 mm, and the base layer of the fixing film 38 has a thickness of 70 μm. The fixing film 38 is made of polyimide (PI) in which carbon fibers are dispersed as a heat conduction filler. On the base layer of the fixing film 38, PFA having a thickness of 13 μm is coated.

The pressing roller 40 has a diameter of 15 mm. The pressing roller 40 is constituted of an aluminum cored bar 41 and an elastic layer 42 and a PFA tube layer having a thickness of 30 μm provided on the aluminum cored bar 41. The elastic layer 42 is a foam rubber layer. A load having a pressing force of 13 kgf is applied between the heating unit 34 and the pressing roller 40. Note that the control temperature of the heater 35 at printing (fixing processing) is 200° C.

The fixing unit 44 is fixed to the body of the image forming apparatus and is configured to be unreplaceable. Both the body of the image forming apparatus and the fixing unit 44 come to the end of their life when 30,000 sheets are printed.

In addition, the fixing unit 44 is miniaturized. Therefore, the temperature of the fixing unit 44 quickly responds to the energization of the heater 35.

The surface layer of the fixing film 38 is coated. Compared with a resin tube, the coating of the surface layer is lower in cost and broadens the range of selecting materials, but tends to reduce durability. Therefore, the fixing film 38 is often used in a small machine having short life.

The elastic layer 42 of the pressing roller 40 has a heat insulating structure in which foaming is performed or resin balloons are added to form air bubbles. In addition, the hardness of the surface of the roller may be set at about 40° using foaming rubber. The pressing roller 40 having the configuration may provide a high heat insulating performance and increase the nip width of the fixing nip portion N. The nip width having this configuration is 6 mm.

Figure 13A:
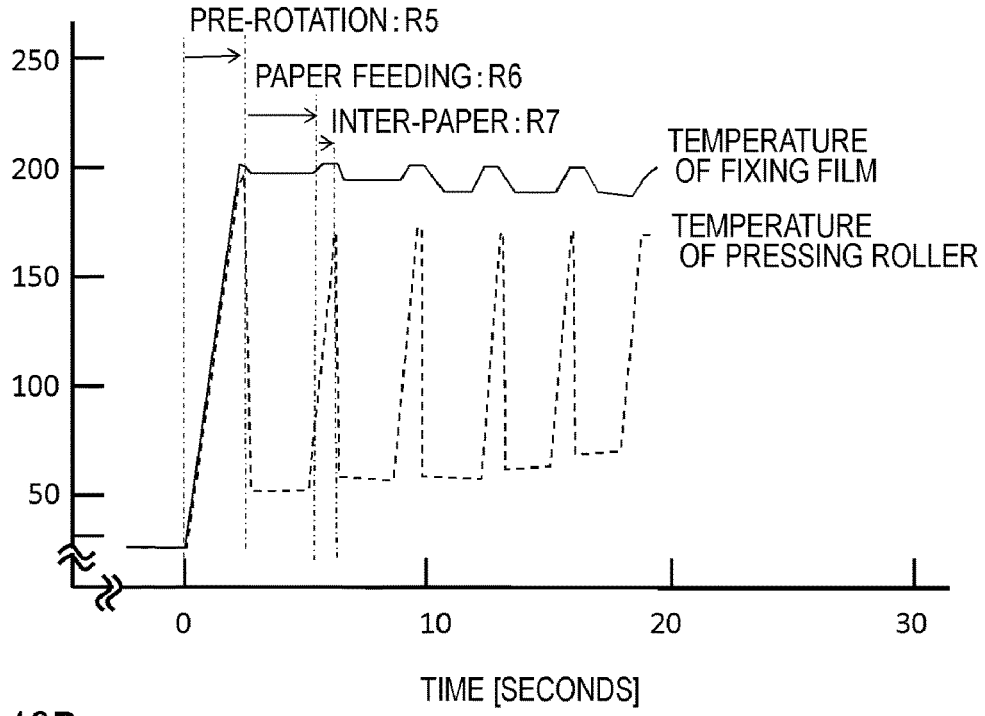
FIGS. 13A and 13B are graphs for describing the temperature of members at paper feeding in the second embodiment.
Figure 13B:
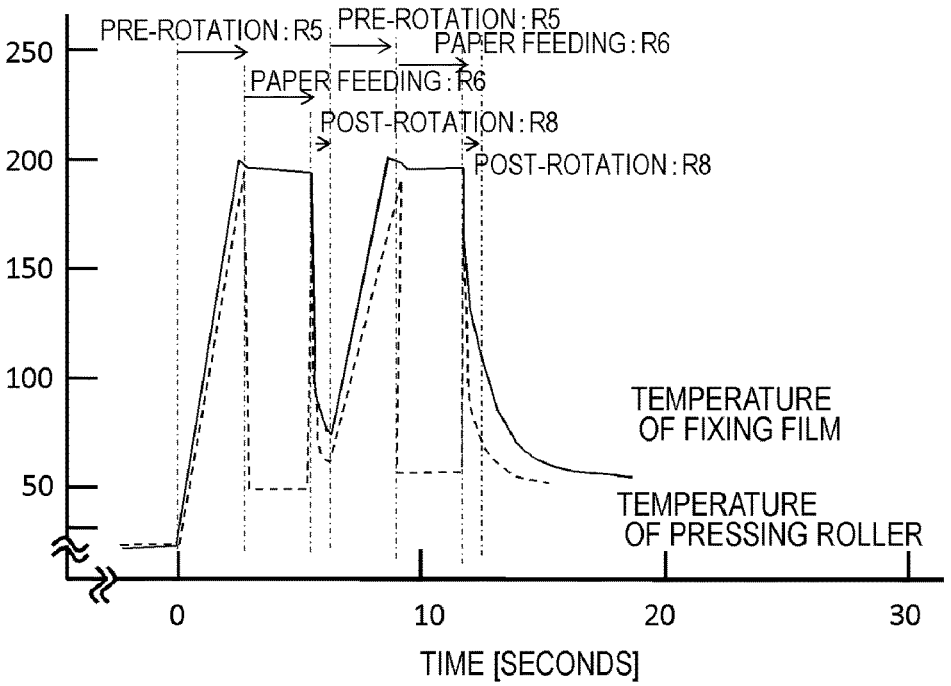

Next, FIGS. 13A and 13B show the temperature transitions of the fixing film 38 and the pressing roller 40 when paper feeding is performed with the configuration. FIG. 13A shows the case of continuous paper feeding, and FIG. 13B shows the case of intermittent paper feeding. In FIGS. 13A and 13B, a horizontal axis shows time, and a vertical axis shows temperature. In addition, a solid line shows the temperature of the fixing film 38, and a broken line shows the temperature of the pressing roller 40. First, a description will be given of the case of the continuous paper feeding in FIG. 13A. As described above, the horizontal axis and the vertical axis show the time and the temperature, respectively. In addition, the solid line and the broken line show the temperature of the fixing film 38 and the temperature of the pressing roller 40, respectively.

In FIG. 13A, a period R5 is a pre-rotation period, and the length of the period R5 equals 3 seconds. A period R6 is a paper feeding period, and the length of the period R6 when A4-size paper (297 mm) is fed equals 3 seconds. A period R7 is an inter-paper period, and the length of the period R7 equals 1 second. The control temperature is 200° C.

During the paper feeding, the surface temperature of the fixing film 38 is 195° C. when the first paper is fed, but then decreases to 180° C. when the third paper is fed. After that, the temperature of the fixing film 38 is maintained at 180° C. during continuous paper feeding. The temperature of the fixing film 38 is less than the control temperature 200° C. This is because a temperature gradient occurs between the front and rear sides of the surface layer due to the poor heat conduction of a mold releasing layer representing the surface layer of the fixing film 38.

The high temperature of the fixing film 38 in the printing of the first paper results from a heat storage effect obtained when the fixing film 38 is heated in the pre-rotation.

The pressing roller 40 has small heat capacity and thus, the pressing roller 40 stores a small amount of heat. Therefore, the pressing roller 40 is maintained at high temperature at non-paper feeding, but the heat of the pressing roller 40 is taken away by a recording material P at the paper feeding and the temperature of the pressing roller 40 immediately decreases.

FIG. 13B shows the temperature of the fixing film 38 and the pressing roller 40 in intermittent printing. In FIG. 13B, a period R8 is a post-rotation period and shows an example of the intermittent printing in which a next job is performed immediately after one sheet is fed as a job. In the case of the intermittent printing as well, the temperature transitions of the fixing film 38 and the pressing roller 40 are the same as those of the case of the continuous printing. Since heat is stored in the fixing film 38 at the post-rotation period R8 and the pre-rotation period R5, however, the temperature of the fixing film 38 is as high as 195° C. every time.

In a case in which the pressing roller 40 is of a heat insulating type as in the second embodiment, a heat supply with the storage of heat in the pressing roller 40 is not performed. Therefore, the temperature of the fixing film 38 is determined only with heat supply from the heater 35 when the recording material P enters the fixing nip portion N. In addition, since the pressing roller 40 has small heat capacity, the temperature of the pressing roller 40 decreases when the recording material P enters the fixing nip portion N. Due to the small heat capacity, the temperature of the pressing roller 40 slowly increases during continuous printing.

Figure 18:
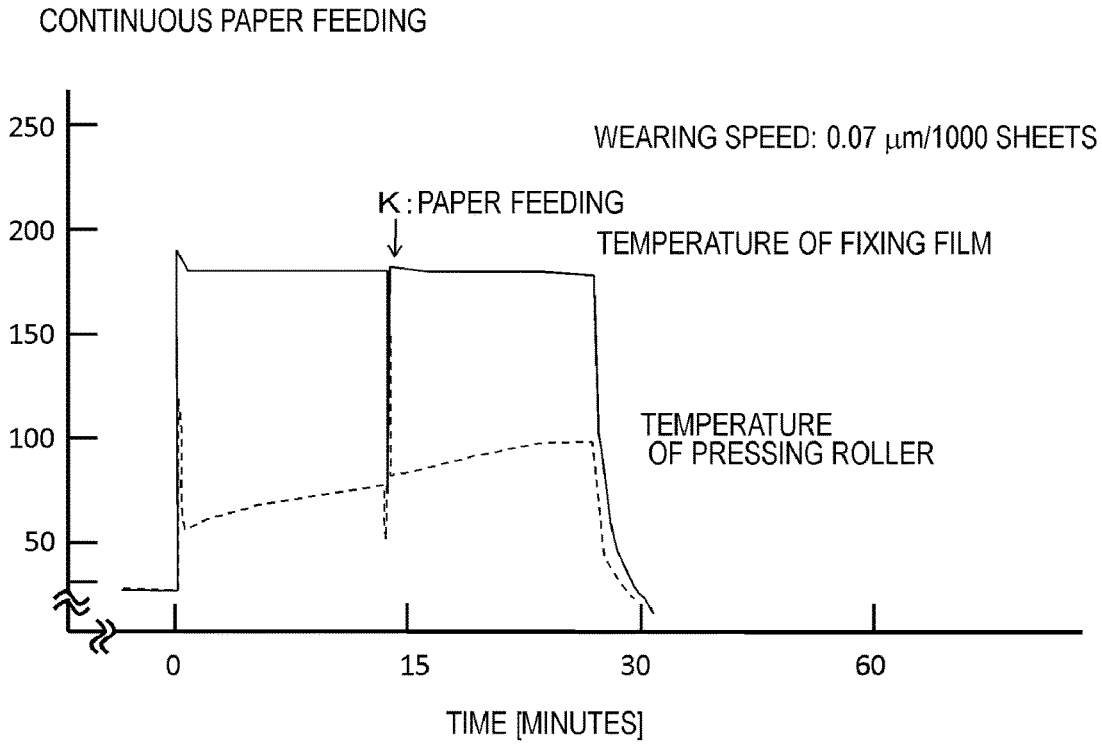
FIG. 18 is a graph for describing the temperature of the members in the case of continuous paper feeding in the second embodiment.
Figure 19:
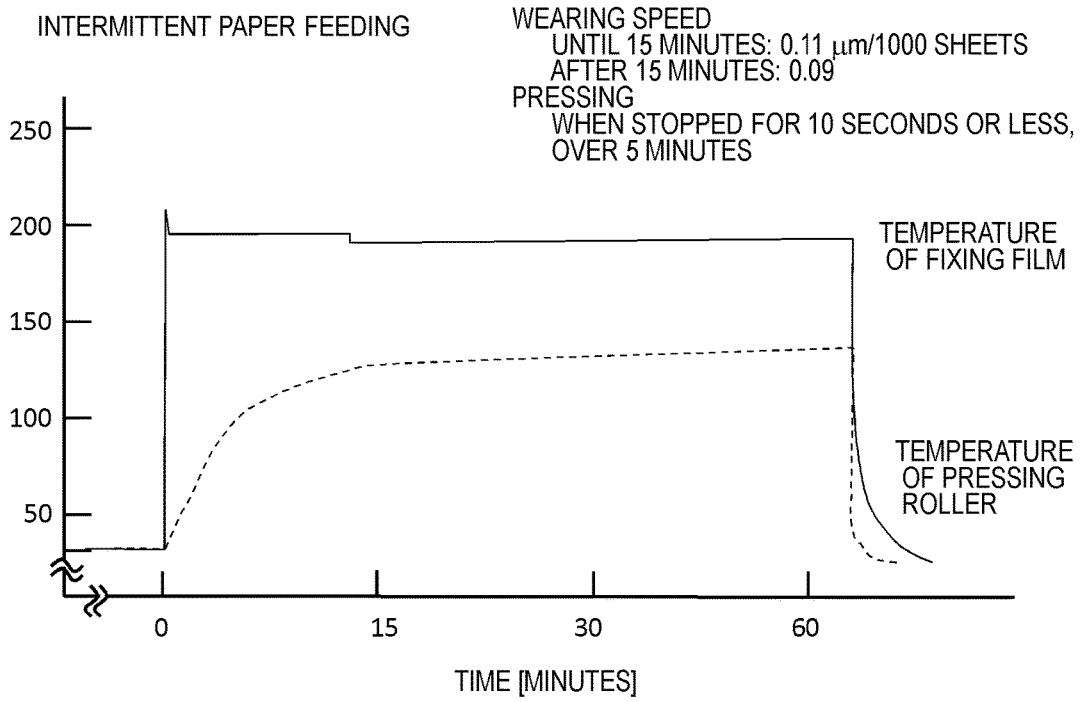
FIG. 19 is a graph for describing the temperature of the members in the case of intermittent paper feeding in the second embodiment.
Figure 20:
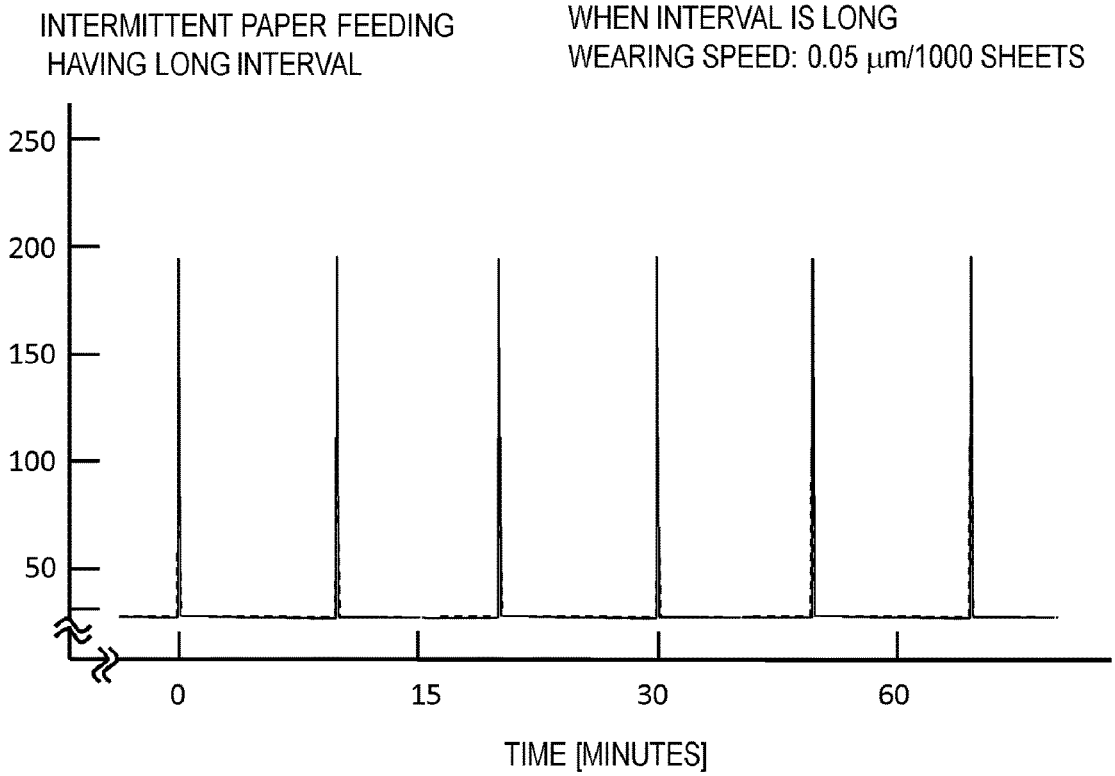
FIG. 20 is a graph for describing the temperature of the members in the case of the intermittent paper feeding having a long interval in the second embodiment.

Next, a description will be given, with reference to FIGS. 18 to 20, of the temperature transitions in cases in which such printing is repeatedly performed. FIG. 18 shows a case in which 400 sheets are printed in the continuous paper feeding shown in FIG. 13A. FIG. 19 shows a case in which the intermittent printing shown in FIG. 13B is performed. FIG. 20 shows a case in which one sheet is printed for every 10 minutes.

When the continuous printing is performed as shown in FIG. 18, the temperature of the fixing film 38 is stabilized at 180° C. The temperature of the pressing roller 40 gradually increases but does not exceed 100° C.

As shown in FIG. 19, the temperature of the pressing roller 40 gradually increases when the intermittent printing is repeatedly performed. In anticipation of this, the control temperature is changed. The control temperature at an early stage is 200° C. At this time, the temperature of the fixing film 38 is 195° C. When the printing time exceeds 15 minutes, the control temperature is 195° C. At this time, the temperature of the fixing film 38 is 190° C. In addition, the temperature of the pressing roller 40 exceeds 100° C. in 5 minutes.

When one sheet is printed at intervals, as shown in FIG. 20, both the temperature of the fixing film 38 and the temperature of the pressing roller 40 increase but do not continuously increase.

The wearing amount of the fixing film 38 becomes more disadvantageous as the diameter of the fixing film 38 is smaller. In addition, compared with a film in which a resin is molded into a tube shape and then is coated on a base layer, like a film in which a tube is coated on a base layer, a film in which a resin film is burned to be formed after being coated on a base layer-like coating tends to wear earlier.

Table 8 shows the relationship between temperature and wearing amounts according to the second embodiment. The wearing amounts in the table are obtained on the condition that the fixing film 38 is heated for 7 seconds or more and wears due to both elastic deformation and viscosity deformation.

Note that time considering the viscosity deformation is the same as that of the case of table 3. A wearing amount due to the elastic deformation is 0.07 μm/1000 sheets ($0.7\times10^{-4}$ μm/sheet).

TABLE 8

Relationship between Temperature and Wearing Amounts

| Temperature | Wearing amount per 1000 sheets [μm] | Wearing amount per sheet [μm] |
|---|---|---|
| Less than 180° C. | 0.1 | $1 \times 10^{-4}$ |
| 180° C. or more and less than 190° C. | 0.2 | $2 \times 10^{-4}$ |
| 190° C. or more and less than 200° C. | 0.3 | $3 \times 10^{-4}$ |
| 200° C. or more | 0.5 | $5 \times 10^{-4}$ |

The hardness of the pressing roller 40 hardly changes when the pressing roller 40 is used at the temperature between room temperature and 100° C. On the other hand, the hardness of the pressing roller 40 reduces by about 1° in 20 hours when the pressing roller 40 is used at a temperature of 100° C. or more.

Figure 14:
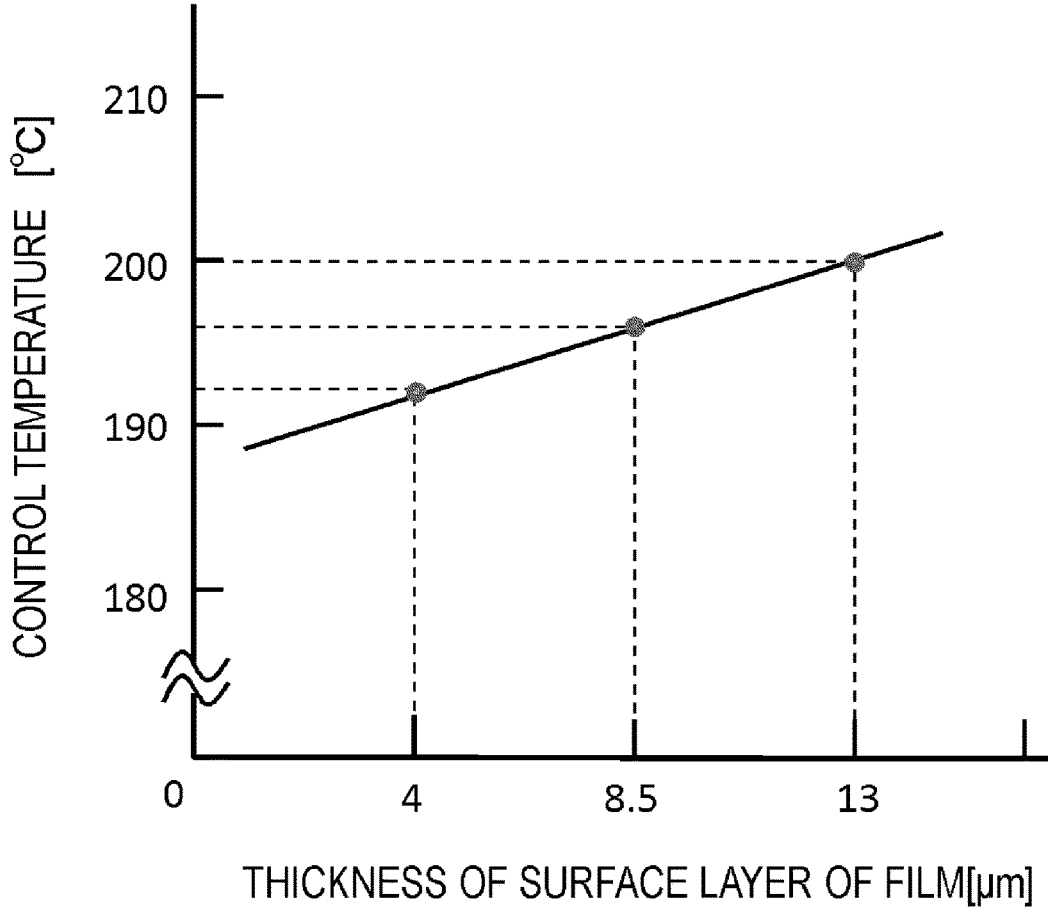
FIG. 14 is a graph showing the relationship between the thickness of the surface layer of a fixing film and a control temperature.

FIG. 14 shows the relationship between the thickness of the fixing film 38 and appropriate control temperature. The relationship may be expressed by the following formula:

$$\text{Control temperature (° C.)} = 0.9\times\text{thickness (μm) of surface layer of film} + 188\text{(° C.)} \quad \text{(Formula 3).}$$

Table 9 shows the hardness of the pressing roller 40, nip widths, and correction amounts of the control temperature.

TABLE 9

Relationship between Hardness of Pressing roller, Nip Widths, and Appropriate Control temperature

| Hardness of pressing roller | Nip width | Change amount of appropriate temperature |
|---|---|---|
| 40° | 6.0 mm | Reference |
| 39° | 6.2 mm | −2° |
| 38° | 6.4 mm | −3° |
| 37° | 6.6 mm | −4° |
| 36° or less | 6.7 mm | −4.5° |

Based on the above conditions, the control temperature and the life are set as follows in the second embodiment.

That is, for every paper feeding, inter-paper time representing time information on the interval between paper feeding at previous time and paper feeding at this time and at least one of rotation driving information and information on the number of fed recording materials P are simultaneously acquired. Information on the number of fed recording materials P of the fixing film 38 and information on the rotating time of the pressing roller 40 are simultaneously acquired and stored as heat history information in a storage medium (not shown) provided in the control portion of the image forming apparatus.

Then, according to the heat history information stored in the storage medium 33, a body control portion (not shown) representing control means changes the control temperature of the heater 11, information on the number of usable sheets, or information on a life alert as the control value of the fixing unit 44.

The calculation is performed based on a change in the thickness of the fixing film 38 and a change in the hardness of the pressing roller 40, but parameters for the calculation are estimated as follows.

Case 1: Case in which one sheet is printed for every 10 minutes or more: Wearing amount of film per sheet: $0.7\times10^{-4}$ μm/sheet (assuming wearing due to only elastic deformation), and Change in hardness of pressing roller per 20-hour rotating time: 0.1°/20 hours.

Case 2: Case in which 20 or more sheets are continuously printed: Wearing amount of film per sheet: $2\times10^{-4}$ μm/sheet, and Change in hardness of pressing roller per 20-hour rotating time: 0.1°/20 hours.

Case 3: Cases other than the above cases: Wearing amount of film per sheet: $3\times10^{-4}$ μm/sheet, Change in hardness of pressing roller per 20-hour rotating time, Less than 5 minutes after start of apparatus operation: 0.1°/20 hours, 5 minutes or more after start of apparatus operation: 1°/20 hours, and Corresponding one of the cases is determined for every print job to estimate the thickness of the surface layer of the fixing film 38 and the hardness of the pressing roller 40.

As for the thickness of the fixing film 38, a wearing amount is estimated for every job. Then, the wearing amount is subtracted from an initial thickness. As for the hardness of the pressing roller 40, the hardness of the pressing roller 40 is estimated according to rotating time for every job.

A change in the control temperature and a reflection on the remaining life (the number of printable sheets) based on the information are made as follows.

As for the fixing film 38, the control temperature is calculated using formula 3 from an obtained thickness to be changed. In addition, a life alert based on the fixing film 38 is performed at a point at which the remaining thickness has become 4 μm.

Next, as for the estimation of the hardness of the pressing roller 40, a hardness reduction ratio for each of the cases is estimated according to rotating time for every job. The apparatus of the second embodiment issues an alert indicating the end of the life of the pressing roller 40 at a point at which the hardness of the pressing roller 40 has reduced by 6° from an initial value. Note that a change in load torque hardly occurs in a foaming elastic layer even if hardness changes. In addition, in a case in which a fixing unit 44 is fixed to the body of an image forming apparatus and a driving motor is commonly used between an image forming portion including a photosensitive drum 1 and a fixing unit 44 like the second embodiment, a driving torque has room in many cases and the problem of a driving failure hardly occurs. Due to these reasons, compared with a case in which the pressing roller 40 of the first embodiment that has a solid rubber layer as an elastic layer is used, a life alert may be issued at a point at which a change in the hardness of the pressing roller 40 has become great when the pressing roller 40 of the second embodiment is used.

A specific example will be described below. A job in which the continuous paper feeding as shown in FIG. 13A is performed corresponds to the case 2. At paper feeding, the temperature of the fixing film 38 does not exceed 180° C. and the temperature of the pressing roller 40 does not exceed 100° C.

The control temperature and the life (body life) of the fixing unit 44 at a point at which 10,000 sheets have been printed are as follows: Control temperature at point at which 10,000 sheets have been printed: 198° C., and Life of fixing unit at point at which 10,000 sheets have been printed: 45,000 sheets.

A job in which the intermittent paper feeding as shown in FIG. 13B is performed corresponds to the case 3. At paper feeding, the temperature of the fixing film 38 is between 190° C. and 195° C. and the temperature of the pressing roller 40 exceeds 100° C. after 5 minutes.

The control temperature and the life (body life) of the fixing unit 44 at a point at which 10,000 sheets have been printed are as follows: Control temperature at point at which 10,000 sheets have been printed: 195° C., and Life of fixing unit at point at which 10,000 sheets have been printed: 30,000 sheets.

In the case 2, the hardness of the pressing roller 40 changes, but the fixing unit 44 comes to the end of the life due to the thickness of the surface layer of the fixing film 38. Therefore, the life of the fixing unit 44 is not influenced by the pressing roller 40.

A job in which printing is performed once for every 10 minutes as shown in FIG. 20 corresponds to the case 1. At paper feeding, the temperature of the fixing film 38 is 195° C. The printing ends, however, before elastic deformation occurs in the surface layer of the fixing film 38. Accordingly, a wearing amount per sheet is $0.7\times10^{-4}$ μm. The temperature of the pressing roller 40 does not exceed 100° C.

The control temperature and the life (body life) of the fixing unit 44 at a point at which 10,000 sheets have been printed are as follows: Control temperature at point at which 10,000 sheets have been printed: 199° C., and Life of fixing unit 44 at point at which 10,000 sheets have been printed: 128,000 sheets.

As described above, an image failure due to the inappropriate setting of the control temperature does not occur and the life alert may be appropriately issued in any of the applied examples.

In actual use situations, it appears that the cases 1, 2, and 3 are mixed together. The setting of the control temperature and the issuance of the life alert may, however, be appropriately performed with the correction of the predicted values of the thickness and the hardness of the pressing roller 40 for every job.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus that prints an image on a recording material, the image forming apparatus comprising:

a fixing unit that fixes an image, formed on a recording material, onto the recording material, the fixing unit having a rotating member with a surface layer, a pressing member that forms a fixing nip portion to sandwich and to transport the recording material with the rotating member, and a heater that heats the rotating member;

a rotating member temperature sensor that detects a temperature of the rotating member;

a wearing amount acquisition portion that acquires a wearing amount of the surface layer of the rotating member, the wearing amount acquisition portion acquiring the wearing amount corresponding to the temperature detected by the rotating member temperature sensor, and the wearing amount acquisition portion acquiring the wearing amount per recording material, the wearing amount per recording material being different depending on the temperature detected by the rotating member temperature sensor; and a control temperature setting portion that sets a control temperature of the heater according to the wearing amount.

2. The image forming apparatus according to claim 1, further comprising:

a pressing member temperature sensor that detects a temperature of the pressing member; and a hardness change amount acquisition portion that acquires a hardness change amount of the pressing member corresponding to the temperature detected by the pressing member temperature sensor, wherein the control temperature setting portion sets the control temperature of the heater according to the wearing amount and the hardness change amount.

3. The image forming apparatus according to claim 1, further comprising a storage portion that stores the control temperature.

4. The image forming apparatus according to claim 1, wherein the rotating member is a film.

5. The image forming apparatus according to claim 4, wherein the heater contacts an inner surface of the film.

6. The image forming apparatus according to claim 5, wherein the pressing member forms the fixing nip portion with the heater via the film.

7. An image forming apparatus that prints an image on a recording material, the image forming apparatus comprising:

a fixing unit that fixes an image, formed on a recording material, onto the recording material, the fixing unit having a rotating member with a surface layer, a pressing member that forms a fixing nip portion to sandwich and to transport the recording material with the rotating member, and a heater that heats the rotating member;

a temperature sensor that detects a temperature of the rotating member;

a wearing amount acquisition portion that acquires a wearing amount of the surface layer of the rotating member, the wearing amount acquisition portion acquiring the wearing amount corresponding to the temperature detected by the temperature sensor, and the wearing amount acquisition portion acquiring the wearing amount per recording material, the wearing amount per recording material being different depending on the temperature detected by the temperature sensor; and a life calculation portion that calculates a life of the rotating member according to the wearing amount.

8. The image forming apparatus according to claim 7, wherein the rotating member is a film.

9. The image forming apparatus according to claim 8, wherein the heater contacts an inner surface of the film.

10. The image forming apparatus according to claim 9, wherein the pressing member forms the fixing nip portion with the heater via the film.

11. An image forming apparatus that prints an image on a recording material, the image forming apparatus comprising:

a fixing unit that fixes an image, formed on a recording material, onto the recording material, the fixing unit having a rotating member, a pressing member that forms a fixing nip portion to sandwich and to transport the recording material with the rotating member, and a heater that heats the rotating member;

a temperature sensor that detects a temperature of the pressing member;

a hardness change amount acquisition portion that acquires a hardness change amount of the pressing member, the hardness change amount acquisition portion acquiring the hardness change amount corresponding to the temperature detected by the temperature sensor; and a control temperature setting portion that sets a control temperature of the heater according to the hardness change amount.

12. The image forming apparatus according to claim 11, wherein the hardness change amount acquisition portion acquires the hardness change amount per unit time, and the hardness change amount per unit time is different depending on the temperature detected by the temperature sensor.

13. The image forming apparatus according to claim 11, further comprising a storage portion that stores the control temperature.

14. The image forming apparatus according to claim 11, wherein the rotating member is a film.

15. The image forming apparatus according to claim 14, wherein the heater contacts an inner surface of the film.

16. The image forming apparatus according to claim 15, wherein the pressing member forms the fixing nip portion with the heater via the film.

17. An image forming apparatus that prints an image on a recording material, the image forming apparatus comprising:

a fixing unit that fixes an image, formed on a recording material, onto the recording material, the fixing unit having a rotating member, a pressing member that forms a fixing nip portion to sandwich and to transport the recording material with the rotating member, and a heater that heats the rotating member;

a temperature sensor that detects a temperature of the pressing member;

a hardness change amount acquisition portion that acquires a hardness change amount of the pressing member, the hardness change amount acquisition portion acquiring the hardness change amount corresponding to the temperature detected by the temperature sensor, and the hardness change amount acquisition portion acquiring the hardness change amount per unit time, the hardness change amount per unit time being different depending on the temperature detected by the temperature sensor; and a life calculation portion that calculates a life of the pressing member according to the hardness change amount.

18. The image forming apparatus according to claim 17, wherein the rotating member is a film.

19. The image forming apparatus according to claim 18, wherein the heater contacts an inner surface of the film.

20. The image forming apparatus according to claim 19, wherein the pressing member forms the fixing nip portion with the heater via the film.

21. An image forming apparatus that prints an image on a recording material, the image forming apparatus comprising:

a fixing unit that fixes an image, formed on a recording material, onto the recording material, the fixing unit having a rotating member with a surface layer, a pressing member that forms a fixing nip portion to sandwich and to transport the recording material with the rotating member, and a heater that heats the rotating member;

a rotating member temperature sensor that detects a temperature of the rotating member;

a wearing amount acquisition portion that acquires a wearing amount of the surface layer of the rotating member, the wearing amount acquisition portion acquiring the wearing amount corresponding to the temperature detected by the rotating member temperature sensor;

a pressing member temperature sensor that detects a temperature of the pressing member;

a hardness change amount acquisition portion that acquires a hardness change amount of the pressing member corresponding to the temperature detected by the pressing member temperature sensor; and a control temperature setting portion that sets a control temperature of the heater according to the wearing amount, and according to the hardness change amount.

22. The image forming apparatus according to claim 21, wherein the rotating member is a film.

23. The image forming apparatus according to claim 22, wherein the heater contacts an inner surface of the film.

24. The image forming apparatus according to claim 23, wherein the pressing member forms the fixing nip portion with the heater via the film.

* * * * *